US010164325B1

(12) United States Patent
Jan et al.

(10) Patent No.: US 10,164,325 B1
(45) Date of Patent: Dec. 25, 2018

(54) COMMUNICATION DEVICE

(71) Applicant: Wistron NeWeb Corp., Hsinchu (TW)

(72) Inventors: Cheng-Geng Jan, Hsinchu (TW); Chieh-Sheng Hsu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/053,705

(22) Filed: Aug. 2, 2018

Related U.S. Application Data

(63) Continuation-in-part of application No. 15/691,640, filed on Aug. 30, 2017.

(30) Foreign Application Priority Data

Jun. 16, 2017 (TW) ..... 106120151

(51) Int. Cl.

| | |
|---|---|
| ***H01Q 21/00*** | (2006.01) |
| ***H01Q 1/24*** | (2006.01) |
| ***H01Q 9/04*** | (2006.01) |
| ***H01Q 7/00*** | (2006.01) |
| ***H01Q 19/10*** | (2006.01) |
| ***H01Q 19/185*** | (2006.01) |
| ***H01Q 9/28*** | (2006.01) |
| ***H01Q 21/06*** | (2006.01) |
| *H01Q 21/28* | (2006.01) |
| *H01Q 15/14* | (2006.01) |
| *H01Q 21/29* | (2006.01) |
| *H01Q 21/22* | (2006.01) |

(52) U.S. Cl.

CPC ..... *H01Q 1/246* (2013.01); *H01Q 7/00* (2013.01); *H01Q 9/0421* (2013.01); *H01Q 9/285* (2013.01); *H01Q 19/108* (2013.01); *H01Q 19/185* (2013.01); *H01Q 21/065* (2013.01); *H01Q 1/242* (2013.01); *H01Q 1/243* (2013.01); *H01Q 15/14* (2013.01); *H01Q 21/22* (2013.01); *H01Q 21/28* (2013.01); *H01Q 21/29* (2013.01)

(58) Field of Classification Search

CPC ..... H01Q 1/242; H01Q 1/243; H01Q 21/28; H01Q 21/29; H01Q 1/241; H01Q 15/14; H01Q 21/22; H01Q 13/10

USPC ..... 343/726, 702

See application file for complete search history.

(56) References Cited

U.S. PATENT DOCUMENTS

2016/0181701 A1* 6/2016 Sangaran ..... H01Q 5/371 343/837

* cited by examiner

*Primary Examiner* — Joseph J Lauture

(57) ABSTRACT

A communication device includes an antenna system. The antenna system includes a first dual-polarized antenna, a second dual-polarized antenna, a first reflector, a second reflector, a first PIFA (Planar Inverted F Antenna), a second PIFA, a third PIFA, a first metal loop, a second metal loop, and a third metal loop. The first reflector is disposed adjacent to the first dual-polarized antenna. The second reflector is disposed adjacent to the second dual-polarized antenna. The first metal loop is disposed adjacent to the first PIFA. The first metal loop is floating and completely separated from the first PIFA. The second metal loop is disposed adjacent to the second PIFA. The second metal loop is floating and completely separated from the second PIFA. The third metal loop is disposed adjacent to the third PIFA. The third metal loop is floating and completely separated from the third PIFA.

20 Claims, 28 Drawing Sheets

COMMUNICATION DEVICE

CROSS REFERENCE TO RELATED APPLICATIONS

This application is a Continuation-In-Part of application Ser. No. 15/691,640, filed on Aug. 30, 2017, which claims the priority of Taiwan Patent Application No. 106120151 filed on Jun. 16, 2017, and the entirety of which are incorporated by reference herein.

BACKGROUND OF THE INVENTION

Field of the Invention

The disclosure generally relates to a communication device, and more particularly, to a communication device and an antenna system therein.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the internet at high speeds. However, since indoor environments have serious signal reflection and multipath fading, wireless access points should process signals in a variety of polarization directions and from a variety of transmission directions simultaneously. Accordingly, it has become a critical challenge for antenna designers to design a high-gain, multi-polarized antenna in the limited space of a wireless access point.

BRIEF SUMMARY OF THE INVENTION

In an exemplary embodiment, the disclosure is directed to a communication device that includes an antenna system. The antenna system includes a first dual-polarized antenna, a second dual-polarized antenna, a first reflector, a second reflector, a first PIFA (Planar Inverted F Antenna), a second PIFA, a third PIFA, a first metal loop, a second metal loop, and a third metal loop. The first reflector is disposed adjacent to the first dual-polarized antenna. The second reflector is disposed adjacent to the second dual-polarized antenna. The first PIFA is at least partially formed by the first reflector. The second PIFA is at least partially formed by the first reflector and the second reflector. The third PIFA is at least partially formed by the second reflector. The first metal loop is disposed adjacent to the first PIFA. The first metal loop is floating and completely separated from the first PIFA. The second metal loop is disposed adjacent to the second PIFA. The second metal loop is floating and completely separated from the second PIFA. The third metal loop is disposed adjacent to the third PIFA. The third metal loop is floating and completely separated from the third PIFA.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
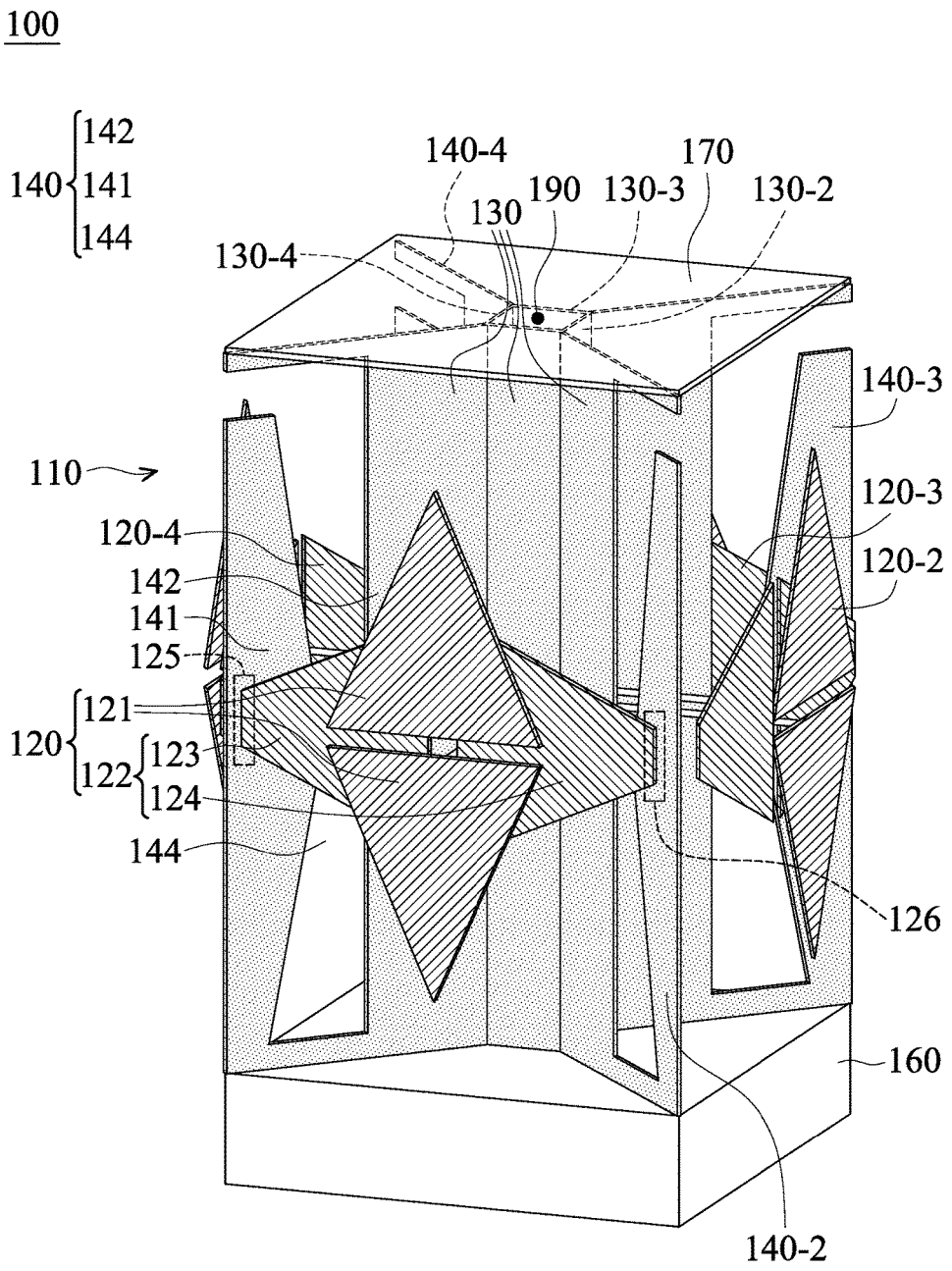
FIG. 1A is a perspective view of a communication device according to an embodiment of the invention.
Figure 1B:
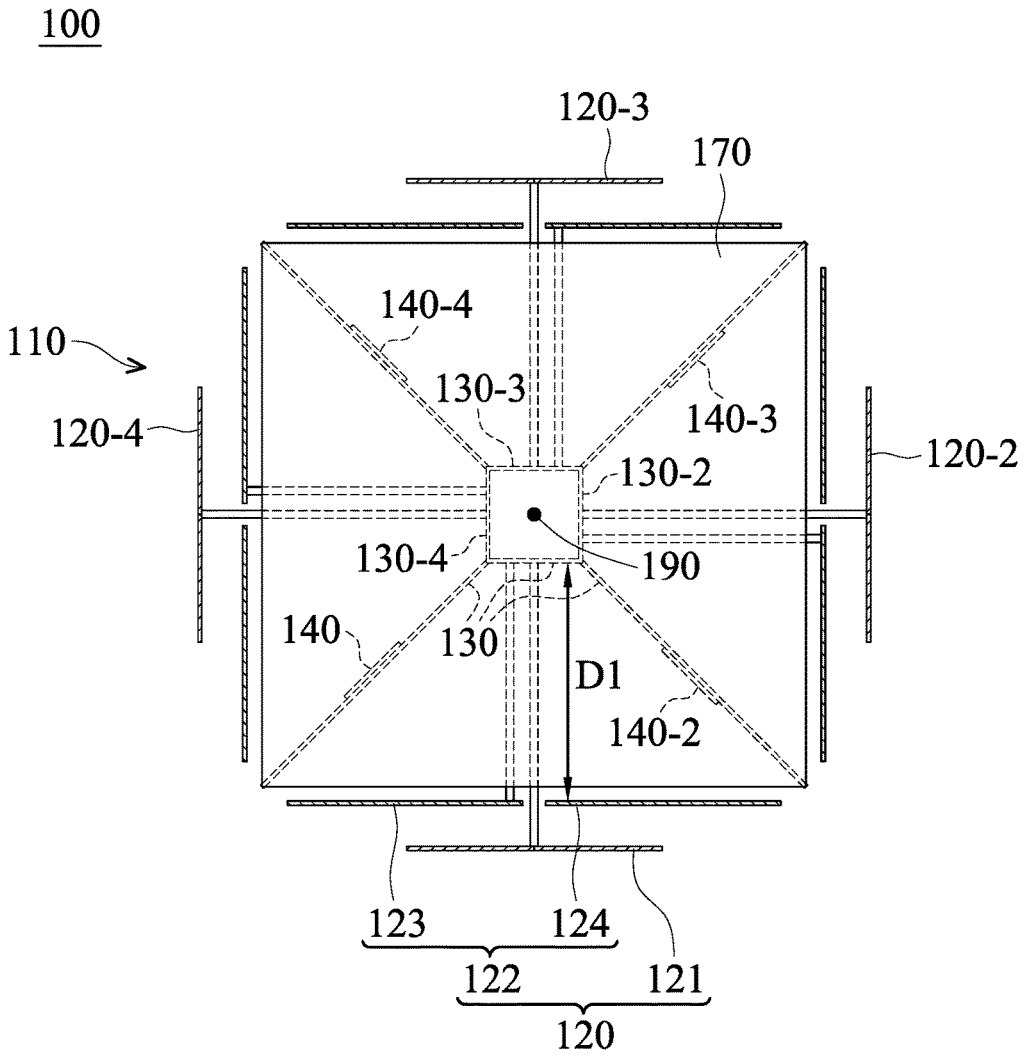
FIG. 1B is a top view of a communication device according to an embodiment of the invention.
Figure 1C:
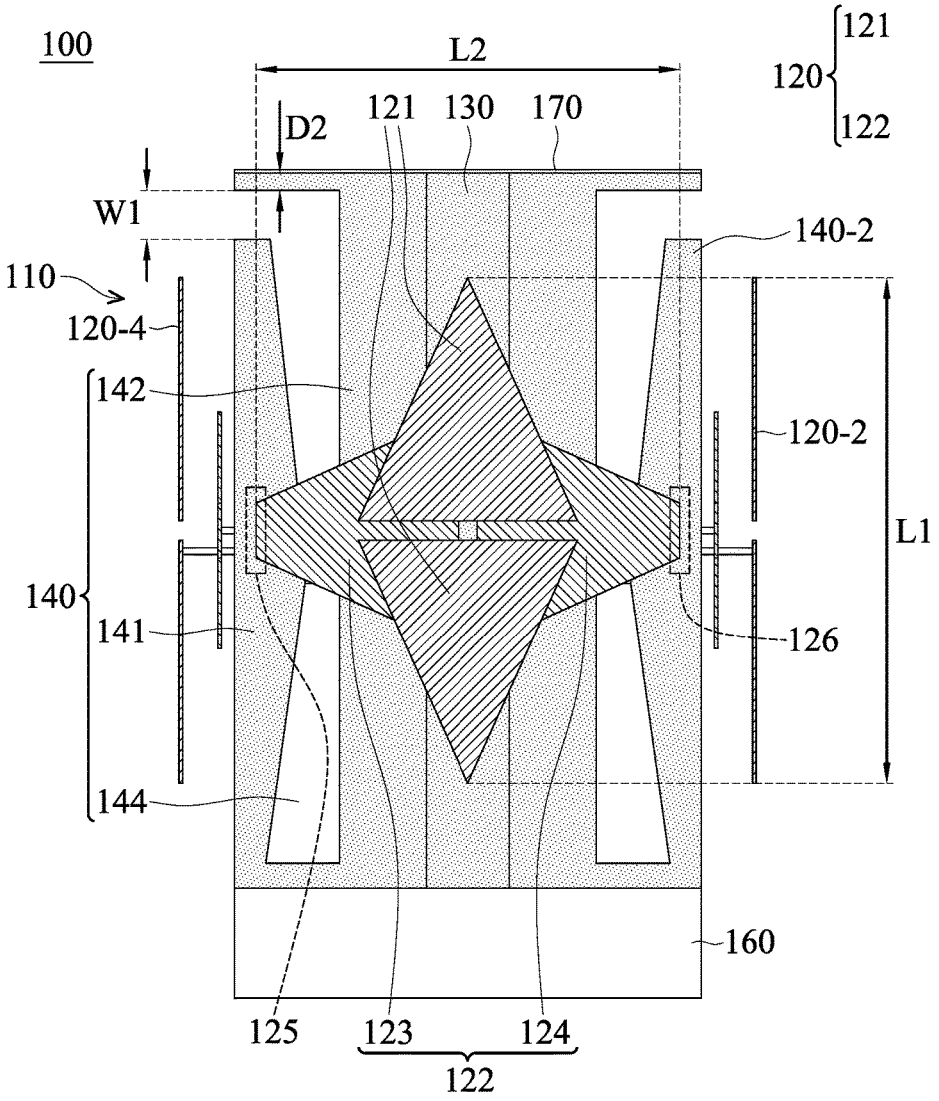
FIG. 1C is a side view of a communication device according to an embodiment of the invention.
Figure 1D:
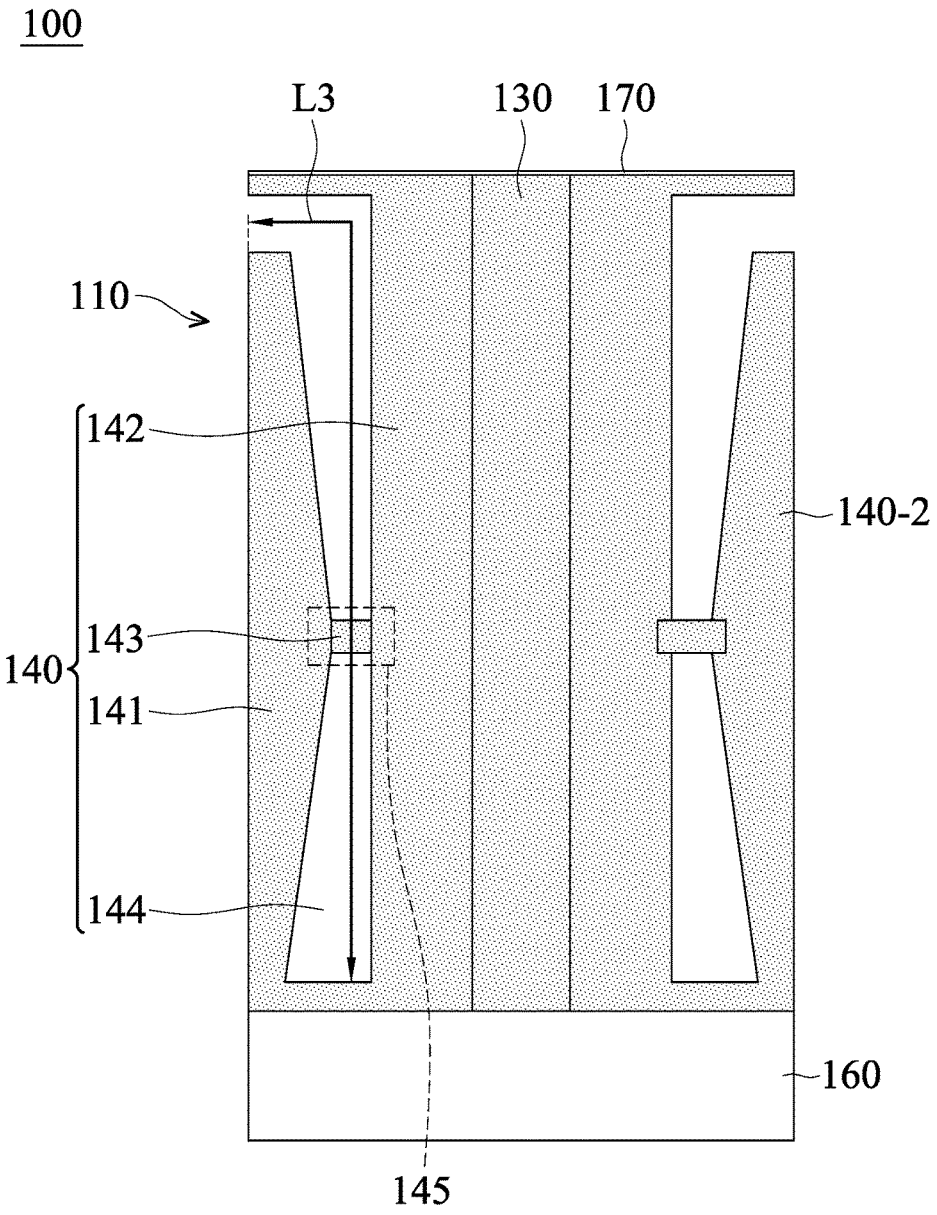
FIG. 1D is a side view of a communication device according to an embodiment of the invention, where all the dipole antennas are removed.

FIG. 1A is a perspective view of a communication device 100 according to an embodiment of the invention. FIG. 1B is a top view of the communication device 100 according to an embodiment of the invention. FIG. 1C is a side view of the communication device 100 according to an embodiment of the invention. The communication device 100 can be applied in a wireless access point. As shown in FIG. 1A, FIG. 1B, and FIG. 1C, the communication device 100 at least includes an antenna system 110. The antenna system 110 at least includes a first dual-polarized antenna 120, a first reflector 130, and a first PIFA (Planar Inverted F Antenna) 140. To avoid the visual obscure, FIG. 1D is a side view of the communication device 100 according to an embodiment of the invention, where all of the dual-polarized antennas (including the first dual-polarized antenna 120) are temporarily removed. Please refer to FIG. 1A, FIG. 1B, FIG. 1C, and FIG. 1D to understand the invention.

The first dual-polarized antenna 120 includes a first diamond-shaped dipole antenna element 121 and a second diamond-shaped dipole antenna element 122. The first diamond-shaped dipole antenna element 121 and the second diamond-shaped dipole antenna element 122 may be spaced apart to each other and perpendicular to each other, so as to achieve the dual-polarized characteristics. For example, if the first diamond-shaped dipole antenna element 121 has a first polarization direction and the second diamond-shaped dipole antenna element 122 has a second polarization direction, the first polarization direction may be perpendicular to the second polarization direction. The diamond-shape of each dipole antenna element is used to increase the high-frequency operation bandwidth of the antenna system 110. It should be noted that, in comparison to the first diamond-shaped dipole antenna element 121, two tip sharp corners of the second diamond-shaped dipole antenna element 122 are both cut and removed, so as to form two truncated tips 125 and 126. For example, the second diamond-shaped dipole antenna element 122 may include a positive radiation arm 123 and a negative radiation arm 124, and the positive radiation arm 123 and the negative radiation arm 124 may each have a substantially trapezoidal shape (a trapezoidal shape is generated by removing a tip sharp corner of a triangular shape). The positive radiation arm 123 and the negative radiation arm 124 are symmetrical. Such a design can reduce the coupling effect between the second diamond-shaped dipole antenna element 122 and the first PIFA 140 in the low-frequency band, thereby increasing the low-frequency isolation between adjacent PIFAs of the antenna system 110.

The first reflector 130 may have a frustum of a pyramidal shape (hollow structure) with a wide top opening and a narrow bottom plate. The wide top opening of the first reflector 130 faces the first dual-polarized antenna 120. Specifically, the wide top opening of the first reflector 130 has a relatively large rectangular shape, and the narrow bottom plate of the first reflector 130 has a relatively small rectangular shape. The first reflector 130 and the first dual-polarized antenna 120 are electrically isolated from each other. The first reflector 130 is configured to eliminate the back-side radiation of the first dual-polarized antenna 120 and to enhance the front-side radiation of the first dual-polarized antenna 120. Accordingly, the antenna gain of the first dual-polarized antenna 120 is increased. The invention is not limited to the above. In alternative embodiments, the first reflector 130 has a lidless triangular cylindrical shape or a lidless circular cylindrical shape (hollow structure), and its top opening still faces the first dual-polarized antenna 120, without affecting the performance of the invention.

The first PIFA 140 is at least partially formed by the first reflector 130. The first PIFA 140 includes a radiation element 141, a grounding element 142, and a feeding element 143. A slot 144 is formed between the radiation element 141 and the grounding element 142. The slot 144 has a varying width so as to increase the low-frequency operation bandwidth of the first PIFA 140. The radiation element 141 and the grounding element 142 of the first PIFA 140 may be a portion of a sidewall of the first reflector 130. The slot 144 may have a varying-width L-shape, and it can at least partially separate the radiation element 141 from the grounding element 142. Specifically, the narrowest portion 145 of the slot 144 is positioned at the middle of the slot 144. Based on the narrowest portion 145, the width of an upper portion of the slot 144 above the narrowest portion 145 gradually increases, and the width of a lower portion of the slot 144 below the narrowest portion 145 also gradually increases. The feeding element 143 may be a coaxial cable. The feeding element 143 extends across the narrowest portion 145 of the varying-width L-shape of the slot 144, and is further coupled to the radiation element 141, so as to excite the first PIFA 140. Such a design can improve the low-frequency impedance matching of the first PIFA 140.

In some embodiments, the first PIFA 140 covers a low-frequency band from 746 MHz to 894 MHz, and the first dual-polarized antenna 120 covers a high-frequency band from 1710 MHz to 2155 MHz. Therefore, the antenna system 110 of the exemplary embodiment of the present invention can support at least the multiband and wideband operation of LTE (Long Term Evolution) Band 13/Band 5/Band 4/Band 2. Furthermore, the multi-polarized property of the antenna system 110 can help to solve the problem of multipath fading in indoor environments.

In some embodiments, the element sizes of the antenna system 110 are as follows. The total length L2 of the first diamond-shaped dipole antenna element 121 is substantially equal to 0.5 wavelength (λ/2) of the central frequency of the aforementioned high-frequency band. The total length L2 of the second diamond-shaped dipole antenna element 122 is substantially equal to 0.5 wavelength (λ/2) of the central frequency of the aforementioned high-frequency band. The total length L3 of the slot 144 of the first PIFA 140 is substantially equal to 0.25 wavelength (λ/4) of the central frequency of the aforementioned low-frequency band. The width W1 of the open end of the slot 144 is substantially equal to the width of the narrowest portion 145 of the slot 144. The length from the open end of the slot 144 to the narrowest portion 145 is slightly longer than the length from the closed end of the slot 144 to the narrowest portion 145. In order to generate constructive interference, the distance D1 between the first reflector 130 and the first dual-polarized antenna 120 (or the second diamond-shaped dipole antenna element 122) is slightly longer than 0.25 wavelength (λ/4) of the central frequency of the aforementioned high-frequency band. The above element sizes are calculated according to many simulation results, and they are arranged for optimizing the gain of all PIFAs of the antenna system 110 and the isolation between the PIFAs. According to the practical measurement, after the two tip sharp corners of the second diamond-shaped dipole antenna element 122 are both cut and removed, the isolation between any two adjacent PIFAs of the antenna system 110 is increased from about 9.8 dB to about 11 dB. Such a design can significantly improve the radiation performance of the antenna system 110.

In some embodiments, the antenna system 110 further includes a second dual-polarized antenna 120-2, a second reflector 130-2, and a second PIFA 140-2. The second dual-polarized antenna 120-2 is disposed opposite to or adjacent to the first dual-polarized antenna 120. The second reflector 130-2 is configured to reflect the radiation energy from the second dual-polarized antenna 120-2. The second PIFA 140-2 is at least partially formed by the second reflector 130-2. The structures and functions of the second dual-polarized antenna 120-2, the second reflector 130-2, and the second PIFA 140-2 are the same as those of the first dual-polarized antenna 120, the first reflector 130, and the first PIFA 140, and the only difference is that they are arranged facing different directions.

In some embodiments, the antenna system 110 further includes a third dual-polarized antenna 120-3, a third reflector 130-3, and a third PIFA 140-3. The third dual-polarized antenna 120-3 is disposed opposite to or adjacent to the first dual-polarized antenna 120. The third reflector 130-3 is configured to reflect the radiation energy from the third dual-polarized antenna 120-3. The third PIFA 140-3 is at least partially formed by the third reflector 130-3. The structures and functions of the third dual-polarized antenna 120-3, the third reflector 130-3, and the third PIFA 140-3 are the same as those of the first dual-polarized antenna 120, the first reflector 130, and the first PIFA 140, and the only difference is that they are arranged facing different directions.

In some embodiments, the antenna system 110 further includes a fourth dual-polarized antenna 120-4, a fourth reflector 130-4, and a fourth PIFA 140-4. The fourth dual-polarized antenna 120-4 is disposed opposite to or adjacent to the first dual-polarized antenna 120. The fourth reflector 130-4 is configured to reflect the radiation energy from the fourth dual-polarized antenna 120-4. The fourth PIFA 140-4 is at least partially formed by the fourth reflector 130-4. The structures and functions of the fourth dual-polarized antenna 120-4, the fourth reflector 130-4, and the fourth PIFA 140-4 are the same as those of the first dual-polarized antenna 120, the first reflector 130, and the first PIFA 140, and the only difference is that they are arranged facing different directions.

In some embodiments, the communication device 100 further includes a metal elevating pillar 160 and a top reflective plate 170. The metal elevating pillar 160 is coupled to the first reflector 130, the second reflector 130-2, the third reflector 130-3, and the fourth reflector 130-4. The metal elevating pillar 160 may have a hollow structure for accommodating a variety of electronic circuit elements, such as a processor, an antenna switching module, and a matching circuit. The metal elevating pillar 160 is configured to support the antenna system 110. The top reflective plate 170 is also coupled to the first reflector 130, the second reflector 130-2, the third reflector 130-3, and the fourth reflector 130-4. The top reflective plate 170 is perpendicular to the first reflector 130, the second reflector 130-2, the third reflector 130-3, and the fourth reflector 130-4. The top reflective plate 170 is configured to reflect the radiation toward the zenith direction, so as to enhance the antenna gain of the antenna system 110. In alternative embodiments, the communication device 100 further includes a nonconductive antenna cover (radome) (not shown). The nonconductive antenna cover has a hollow structure (e.g., a hollow circular cylinder or a hollow square cylinder, which has a top lid but no bottom lid). The antenna system 110 and the top reflective plate 170 are both completely inside the nonconductive antenna cover. The nonconductive antenna cover is configured to protect the antenna system 110 from interference from the environment. For example, the nonconductive antenna cover may have waterproofing and sun-protection functions.

Please refer to FIG. 1A, FIG. 1B, FIG. 1C, and FIG. 1D again. The first dual-polarized antenna 120, the second dual-polarized antenna 120-2, the third dual-polarized antenna 120-3, and the fourth dual-polarized antenna 120-4 are arranged symmetrically with respect to their central point 190. The first dual-polarized antenna 120, the second dual-polarized antenna 120-2, the third dual-polarized antenna 120-3, and the fourth dual-polarized antenna 120-4 each covers a 90-degree spatial angle. Similarly, the first reflector 130, the second reflector 130-2, the third reflector 130-3, the fourth reflector 130-4, the first PIFA 140, the second PIFA 140-2, the third PIFA 140-3, and the fourth PIFA 140-4 are also arranged symmetrically with respect to their central point 190. The first PIFA 140, the second PIFA 140-2, the third PIFA 140-3, and the fourth PIFA 140-4 can cover the same low-frequency band (e.g., from 746 MHz to 894 MHz). The first dual-polarized antenna 120, the second dual-polarized antenna 120-2, the third dual-polarized antenna 120-3, and the fourth dual-polarized antenna 120-4 cover the same high-frequency band (e.g., from 1710 MHz to 2155 MHz). In some embodiments, the antenna system 110 is a beam switching antenna assembly for using all of the first PIFA 140, the second PIFA 140-2, the third PIFA 140-3, and the fourth PIFA 140-4 at the same time, so as to perform low-frequency signal reception and transmission. The beam switching antenna assembly is further arranged for selectively using at least two of the first dual-polarized antenna 120, the second dual-polarized antenna 120-2, the third dual-polarized antenna 120-3, and the fourth dual-polarized antenna 120-4, so as to perform high-frequency signal reception and transmission. For example, when reception signals come from a variety of directions, the antenna system 110 can enable only two dual-polarized antennas toward the direction of maximum signal strength, and disable other dual-polarized antennas. It should be understood that, although there are exactly four dual-polarized antennas and four PIFAs displayed in FIG. 1A, FIG. 1B, FIG. 1C, and FIG. 1D, in fact, the antenna system 110 may include more or fewer antennas. For example, the antenna system 110 may include one or more of the first dual-polarized antenna 120, the second dual-polarized antenna 120-2, the third dual-polarized antenna 120-3, and the fourth dual-polarized antenna 120-4, and/or one or more of the first PIFA 140, the second PIFA 140-2, the third PIFA 140-3, and the fourth PIFA 140-4. Generally, if the antenna system 110 includes N dual-polarized antennas and N PIFAs (e.g., N may be an integer greater than or equal to 2), the N dual-polarized antennas and the N PIFAs are arranged on the same circumference at equal intervals, and each minor arc between any two adjacent dual-polarized antennas or any two adjacent PIFAs has 360/N degrees.

Figure 2A:
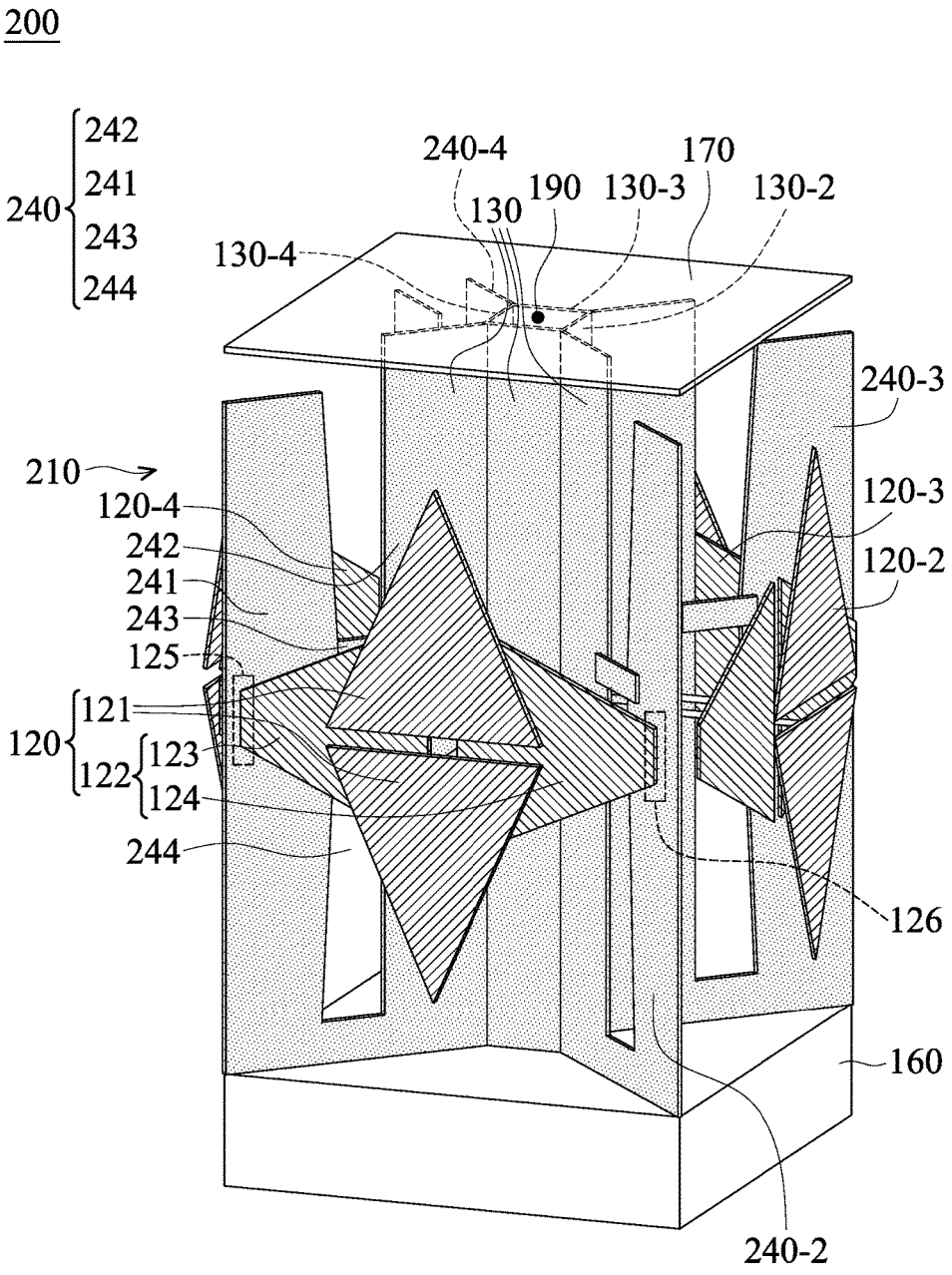
FIG. 2A is a perspective view of a communication device according to an embodiment of the invention.
Figure 2B:
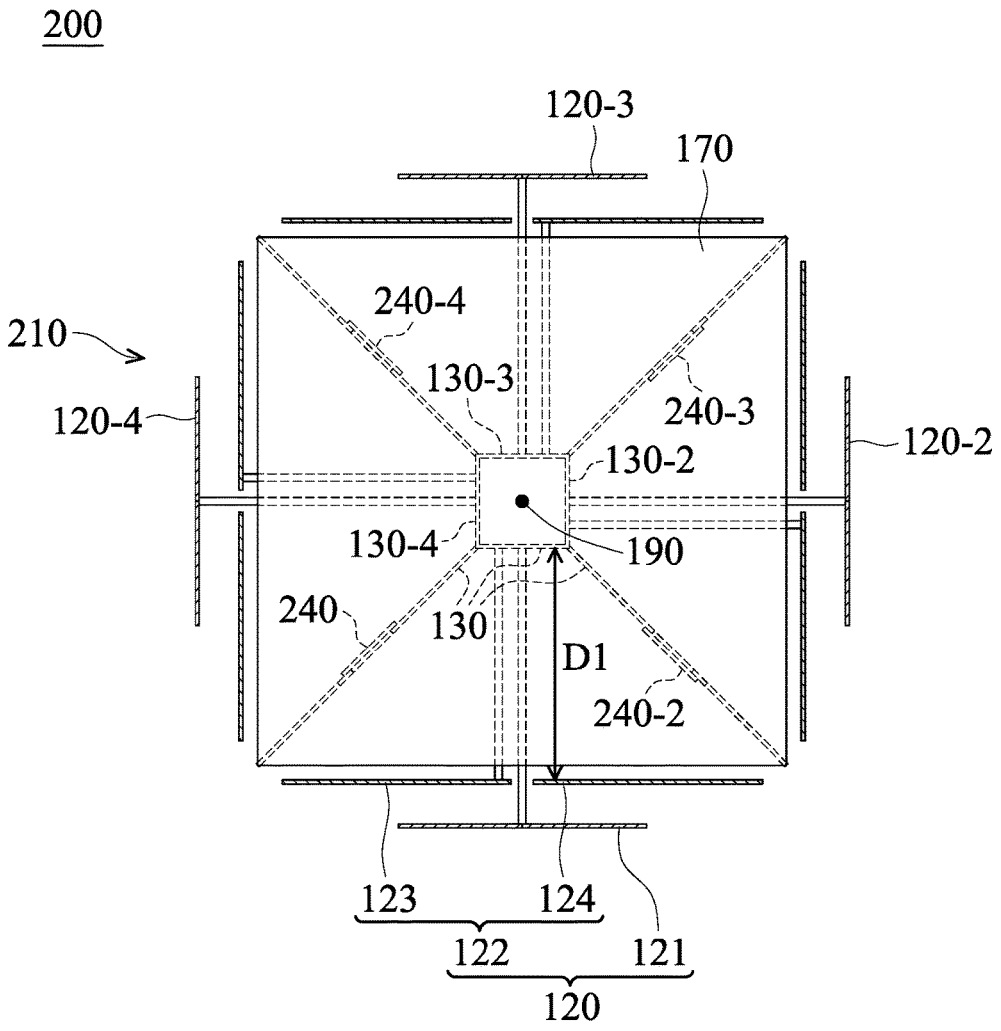
FIG. 2B is a top view of a communication device according to an embodiment of the invention.
Figure 2C:
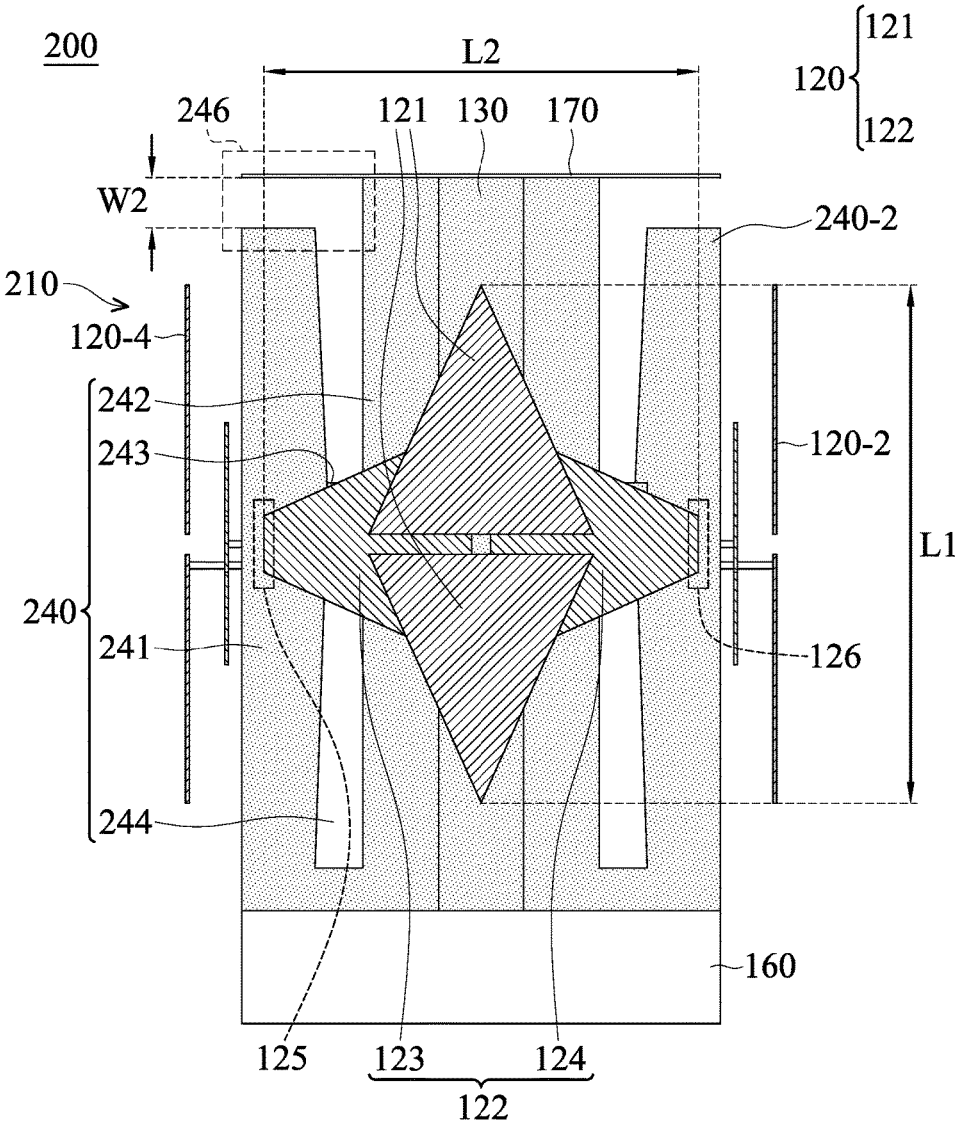
FIG. 2C is a side view of a communication device according to an embodiment of the invention.
Figure 2D:
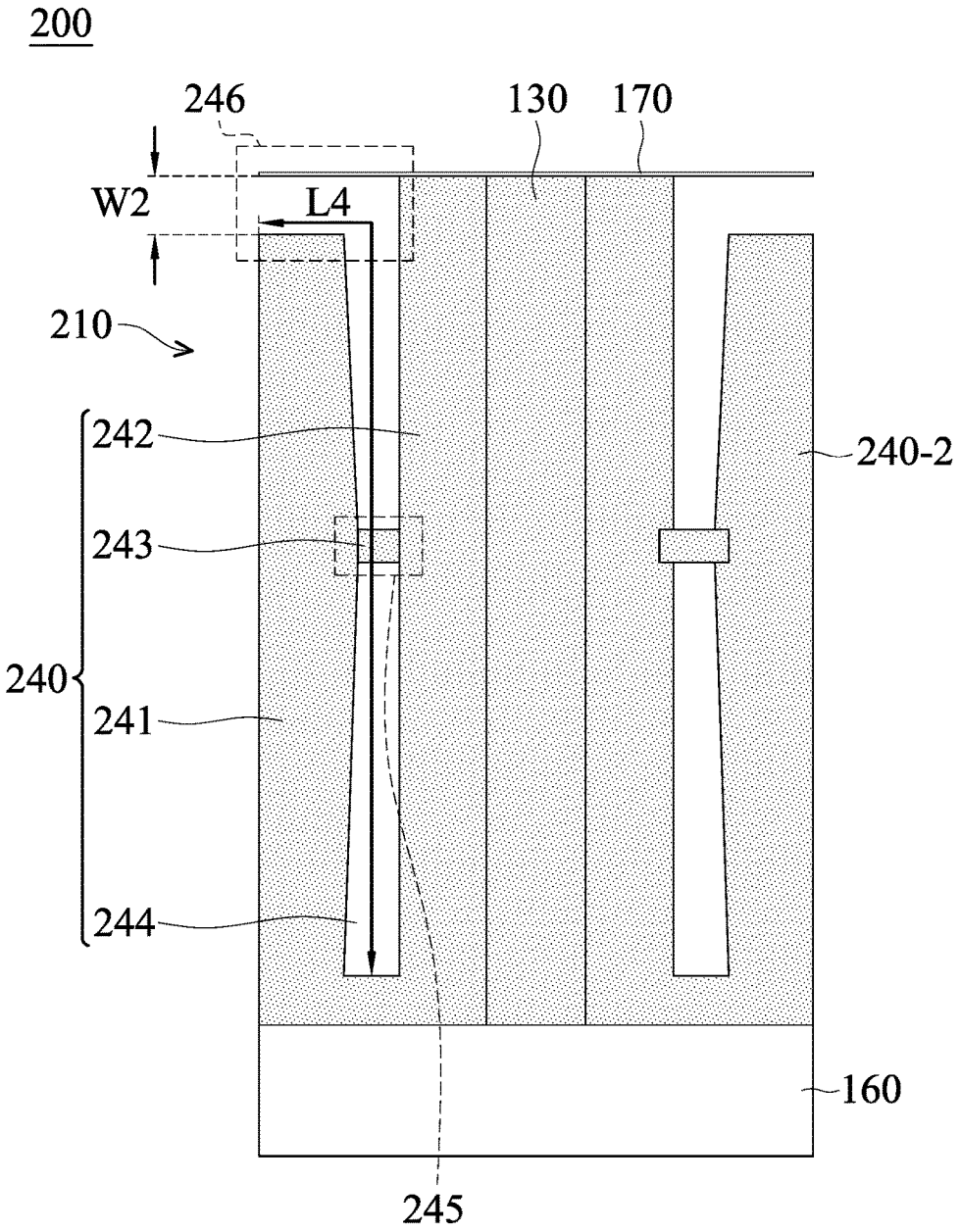
FIG. 2D is a side view of a communication device according to an embodiment of the invention, where all the dipole antennas are removed.

FIG. 2A is a perspective view of a communication device 200 according to an embodiment of the invention. FIG. 2B is a top view of the communication device 200 according to an embodiment of the invention. FIG. 2C is a side view of the communication device 200 according to an embodiment of the invention. FIG. 2D is a side view of the communication device 200 according to an embodiment of the invention, where all dual-polarized antennas are temporarily removed. In the embodiment of FIG. 2A, FIG. 2B, FIG. 2C, and FIG. 2D, an antenna system 210 of the communication device 200 includes a different first PIFA 240. The first PIFA 240 includes a radiation element 241, a grounding element 242, and a feeding element 243. A slot 244 is formed between the radiation element 241 and the grounding element 242. The slot 244 may have a varying-width L-shape, and it can at least partially separate the radiation element 241 from the grounding element 242. Specifically, the narrowest portion 245 of the slot 244 is positioned at the middle of the slot 244. Based on the narrowest portion 245, the width of an upper portion of the slot 244 above the narrowest portion 245 gradually increases, and the width of a lower portion of the slot 244 below the narrowest portion 245 also gradually increases. The total length L4 of the slot 244 of the first PIFA 240 is substantially equal to 0.25 wavelength ($\lambda/4$) of the central frequency of the low-frequency band of the antenna system 210. The width W2 of the open end of the slot 244 is substantially equal to the width of the narrowest portion 245 of the slot 244. The length from the open end of the slot 244 to the narrowest portion 245 is slightly longer than the length from the closed end of the slot 244 to the narrowest portion 245. The difference from the embodiment of FIG. 1A, FIG. 1B, FIG. 1C, and FIG. 1D is that a bending portion 246 of the slot 244 directly touches the top reflective plate 170 (i.e., referring to FIG. 1C, the distance D2 between the slot 144 and the top reflective plate 170 is reduced to 0). According to the practical measurement, after the distance between the bending portion 246 of the slot 244 and the top reflective plate 170 is reduced to 0, the antenna gain of the first PIFA 240 is slightly increased by about 0.5 dBi to about 0.7 dBi. In other embodiments, the antenna system 210 further includes one or more of a second PIFA 240-2, a third PIFA 240-3, and a fourth PIFA 240-4. The structures and functions of the second PIFA 240-2, the third PIFA 240-3, and the fourth PIFA 240-4 are the same as those of the first PIFA 240, and the only difference is that they are arranged facing different directions. Other features of the communication device 200 of FIG. 2A, FIG. 2B, FIG. 2C, and FIG. 2D are similar to those of the communication device 100 of FIG. 1A, FIG. 1B, FIG. 1C, and FIG. 1D. Accordingly, the two embodiments can achieve similar levels of performance.

Figure 3A:
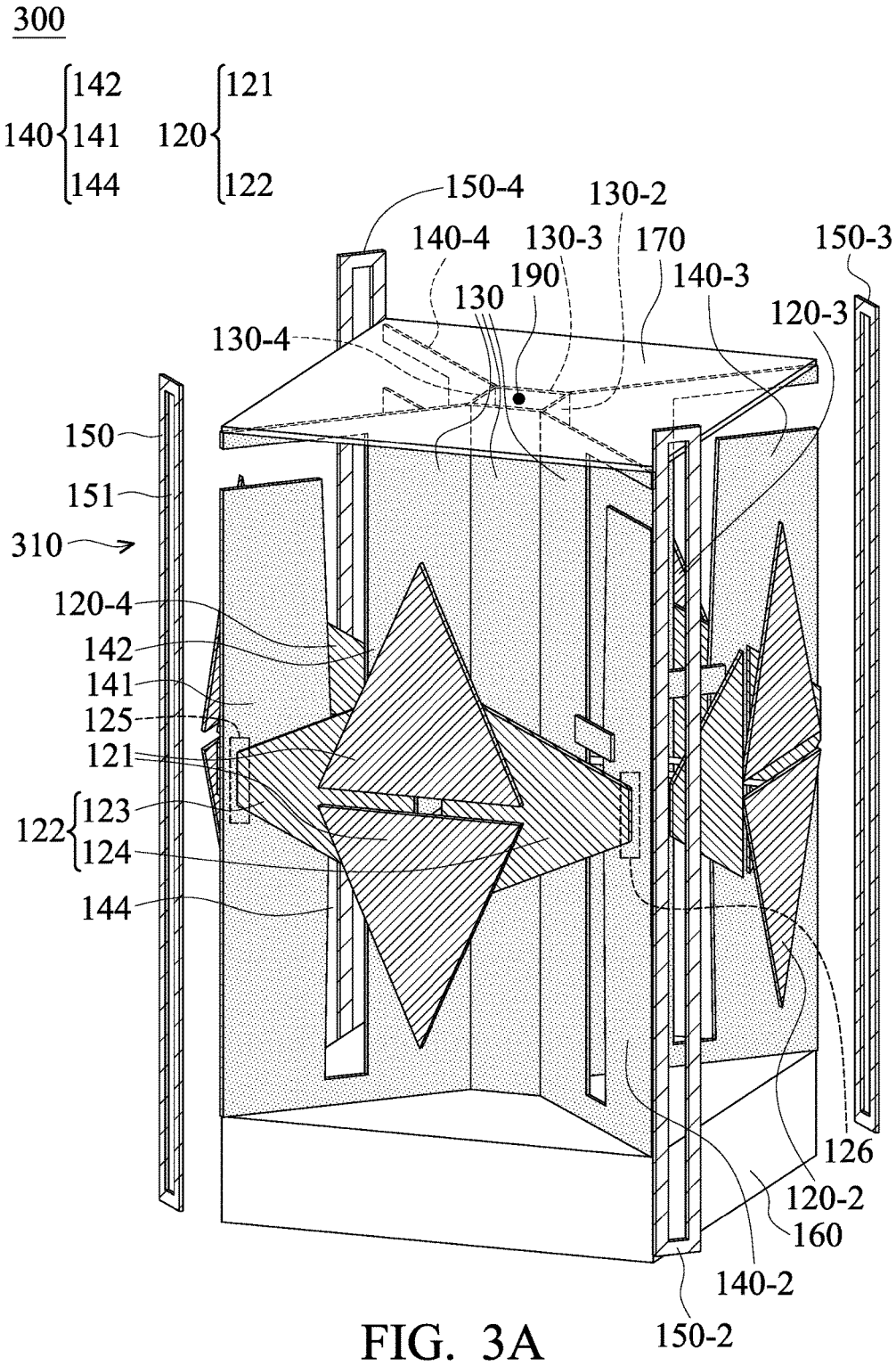
FIG. 3A is a perspective view of a communication device according to an embodiment of the invention.
Figure 3B:
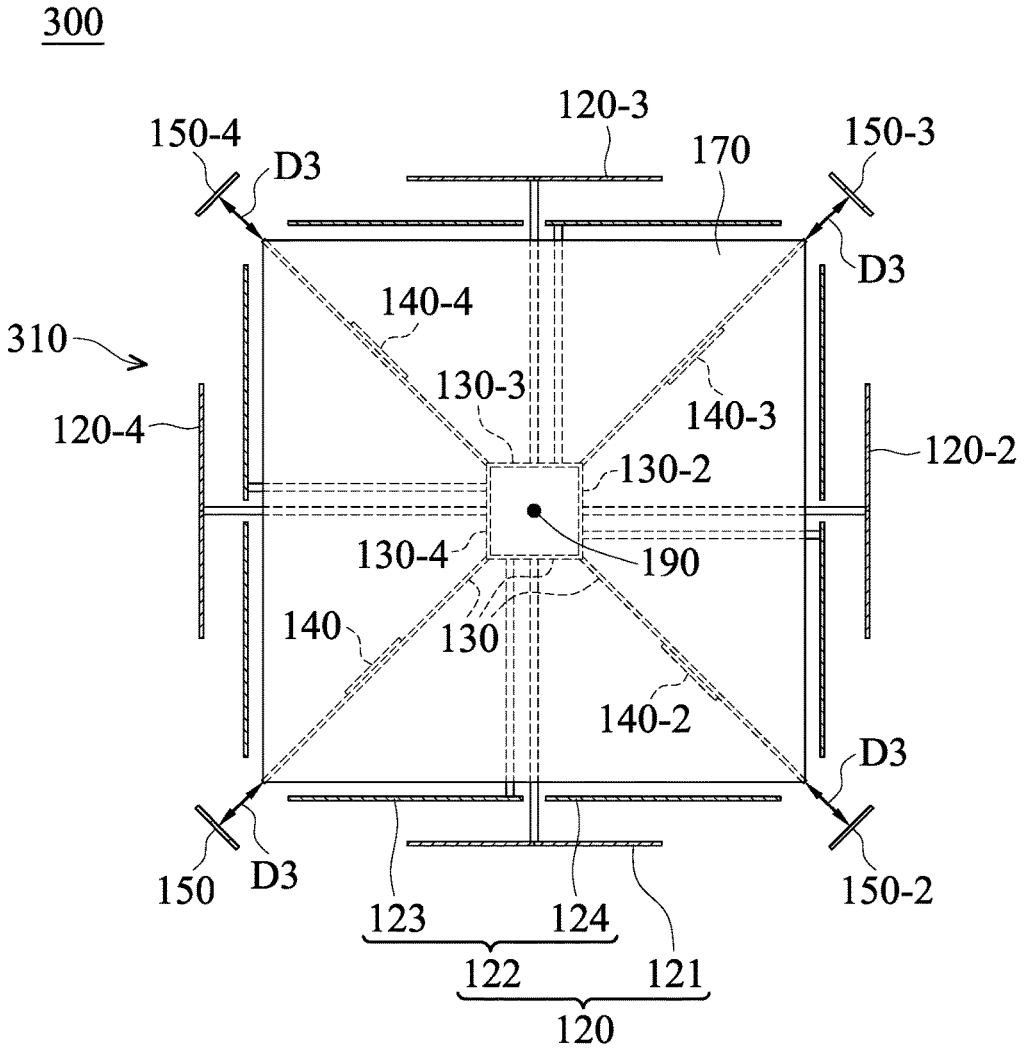
FIG. 3B is a top view of a communication device according to an embodiment of the invention.
Figure 3C:
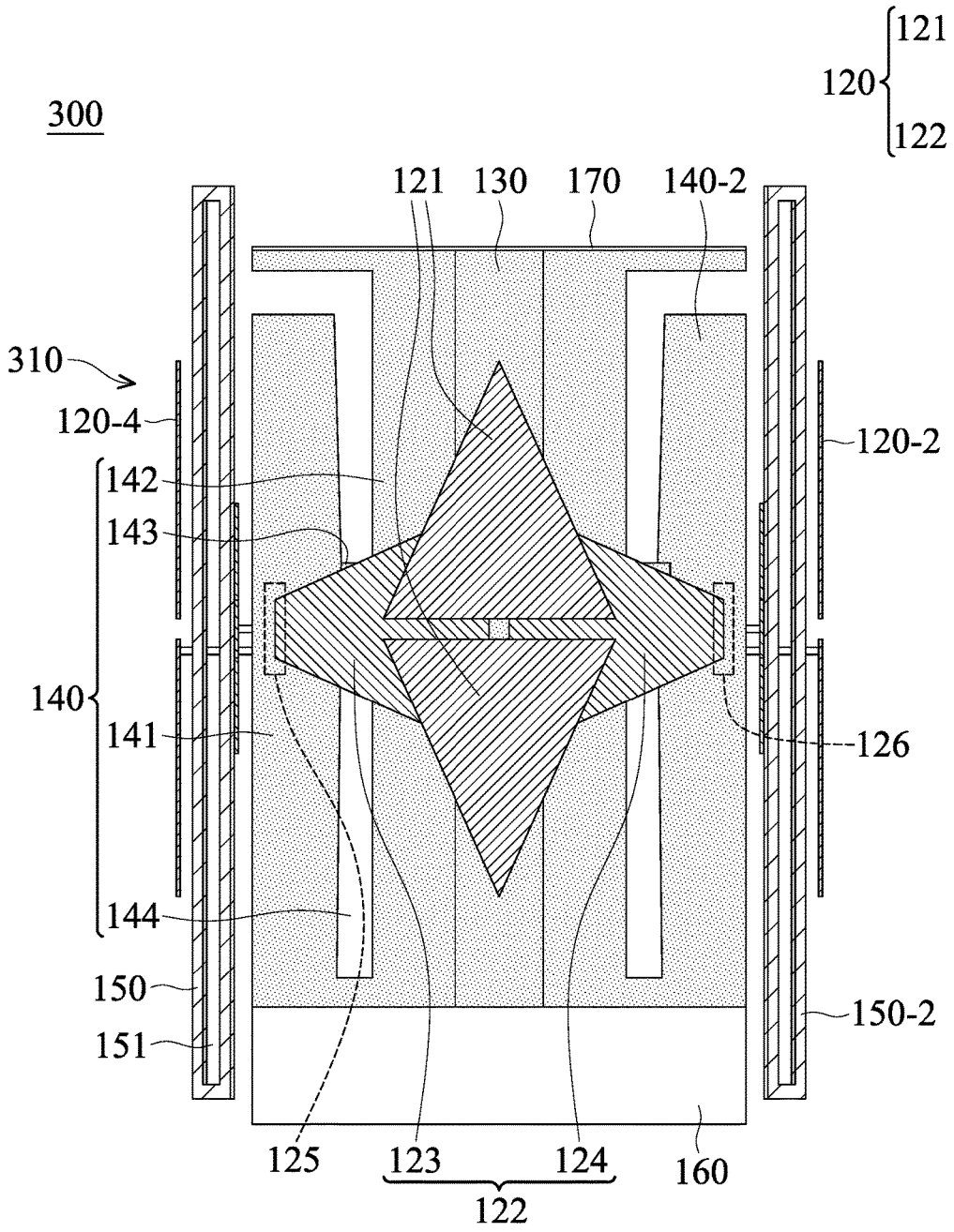
FIG. 3C is a side view of a communication device according to an embodiment of the invention.
Figure 3D:
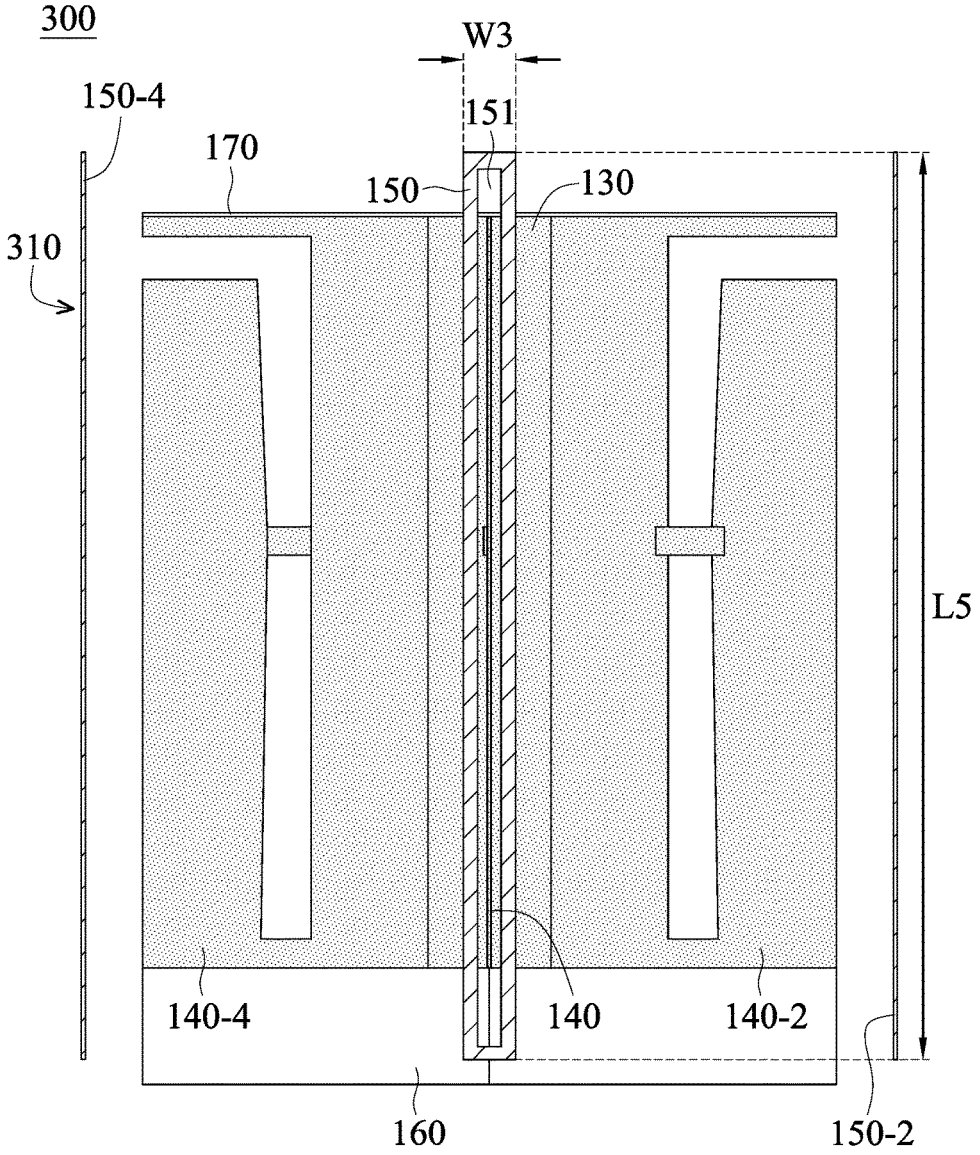
FIG. 3D is a side view of a communication device according to an embodiment of the invention, where all the dipole antennas are removed.

FIG. 3A is a perspective view of a communication device 300 according to an embodiment of the invention. FIG. 3B is a top view of the communication device 300 according to an embodiment of the invention. FIG. 3C is a side view of the communication device 300 according to an embodiment of the invention. FIG. 3D is a side view of the communication device 300 according to an embodiment of the invention, where all dual-polarized antennas are temporarily removed. In the embodiment of FIG. 3A, FIG. 3B, FIG. 3C, and FIG. 3D, an antenna system 310 of the communication device 300 further includes a first metal loop 150 disposed adjacent to the first PIFA 140. In order to optimize the impedance matching of the antenna system 310, the shape and width of the first PIFA 140 are fine-tuned in the embodiment of FIG. 3A, FIG. 3B, FIG. 3C, and FIG. 3D, but the slot of the first PIFA 140 still substantially has a varying-width L-shape. The first metal loop 150 is floating, and is completely separated from the first PIFA 140. For example, the distance D3 between the first metal loop 150 and the first PIFA 140 may be from 5 mm to 15 mm, such as 9.55 mm. Specifically, the first PIFA 140 is positioned between the first metal loop 150 and the narrow bottom plate of the first reflector 130. The first metal loop 150 may have a hollow rectangular shape. A rectangular hollow portion 151 may be formed inside the first metal loop 150. The length L5 of the first metal loop 150 is from 0.25 to 0.5 wavelength ($\lambda/4$ to $\lambda/2$) of the central frequency of the low-frequency band of the antenna system 310. For example, the first metal loop 150 may extend upward above the top reflective plate 170, and/or may extend downward below the metal elevating pillar 160. With respect to the operation theory, the first metal loop 150 is configured to partially reflect and partially pass electromagnetic waves of the first PIFA 140, so as to induce the constructive interference thereof. Accordingly, the antenna gain of the first PIFA 140 is increased. According to the practical measurement, after the first metal loop 150 is added, the antenna gain of the first PIFA 140 is significantly increased by about 3 dBi to about 4 dBi. In alternative embodiments, the first metal loop 150 is replaced with a solid rectangular metal piece having the same size (i.e., the rectangular hollow portion 151 is completely filled with a metal material), without affecting its performance. Furthermore, if the width W3 of the first metal loop 150 increases, the length L5 of the first metal loop 150 will decrease correspondingly. Conversely, if the width W3 of the first metal loop 150 decreases, the length L5 of the first metal loop 150 will increase correspondingly. In other embodiments, the antenna system 310 further includes one or more of a second metal loop 150-2, a third metal loop 150-3, and a fourth metal loop 150-4, which are adjacent to the second PIFA 140-2, the third PIFA 140-3, and the fourth PIFA 140-4, respectively. The structures and functions of the second metal loop 150-2, the third metal loop 150-3, and the fourth metal loop 150-4 are the same as those of the first metal loop 150, and the only difference is that they are arranged facing different directions. Other features of the communication device 300 of FIG. 3A, FIG. 3B, FIG. 3C, and FIG. 3D are similar to those of the communication device 100 of FIG. 1A, FIG. 1B, FIG. 1C, and FIG. 1D. Accordingly, the two embodiments can achieve similar levels of performance.

Figure 4A:
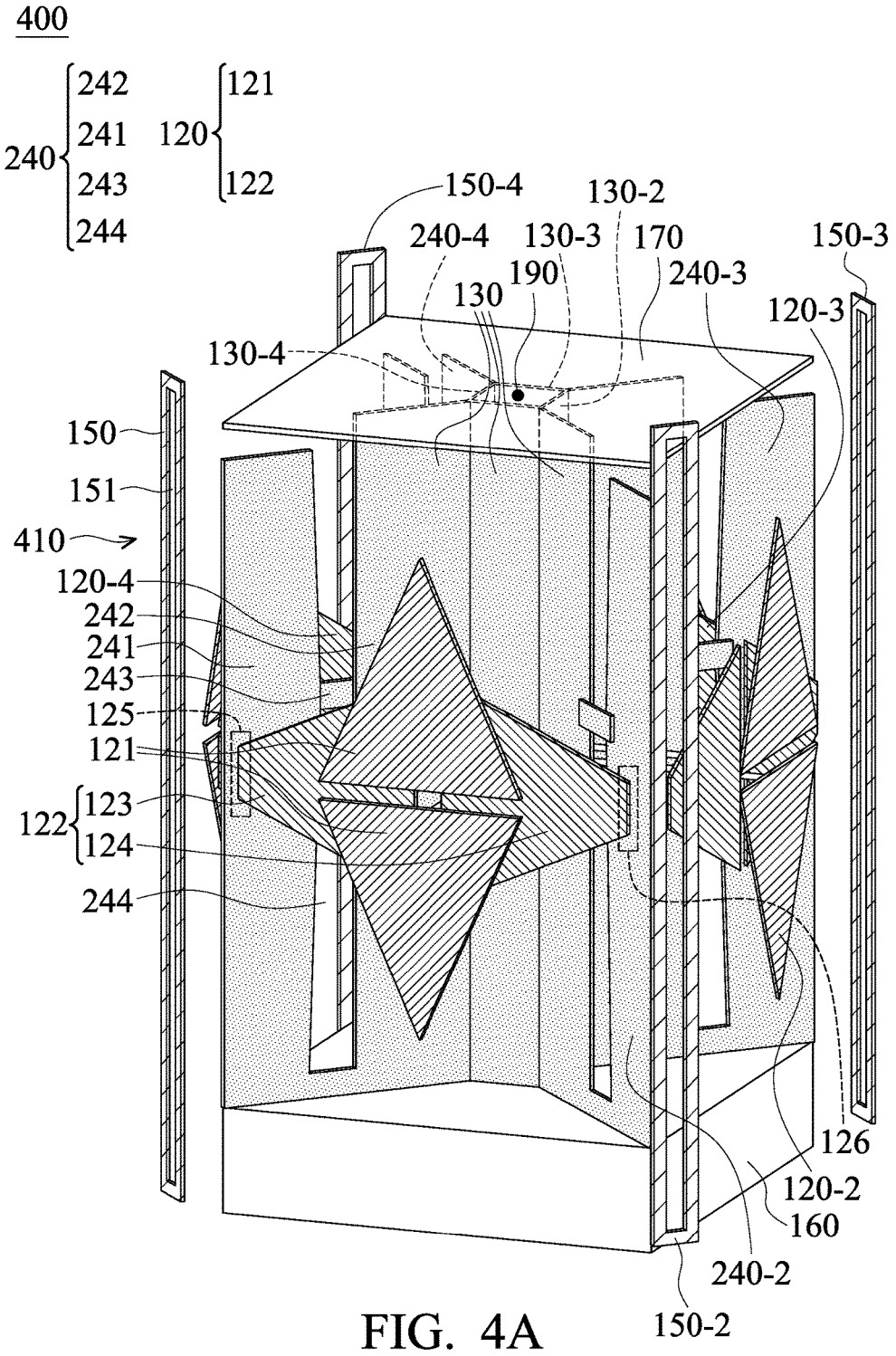
FIG. 4A is a perspective view of a communication device according to an embodiment of the invention.
Figure 4B:
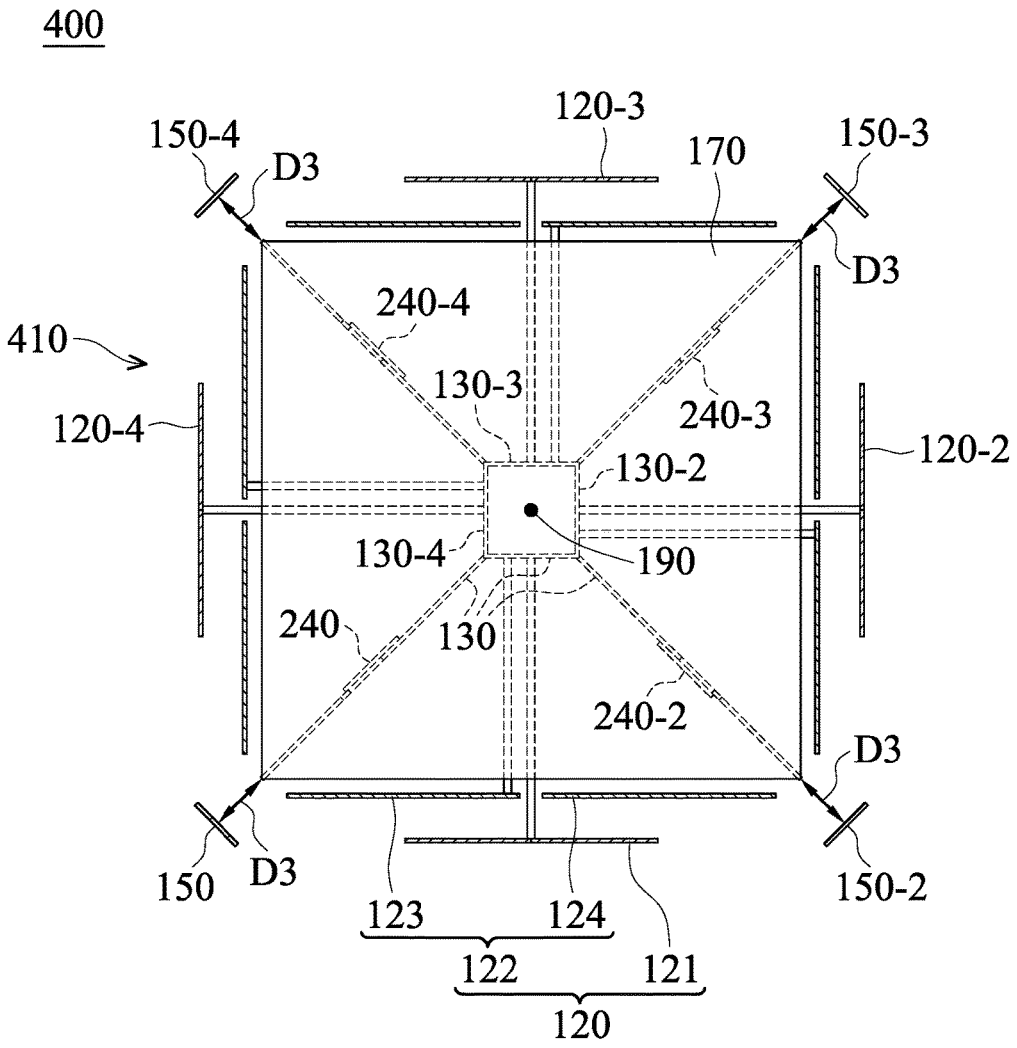
FIG. 4B is a top view of a communication device according to an embodiment of the invention.
Figure 4C:
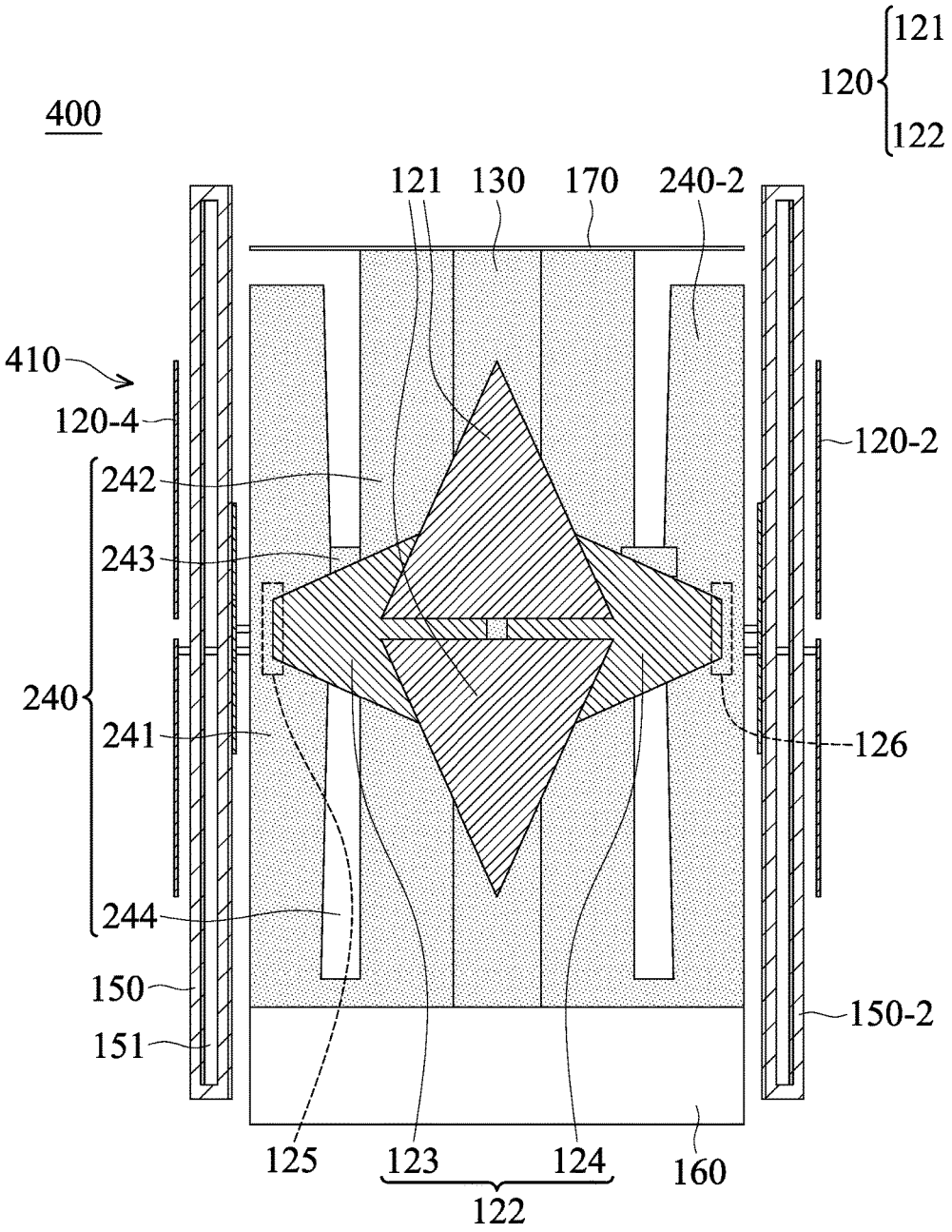
FIG. 4C is a side view of a communication device according to an embodiment of the invention.
Figure 4D:
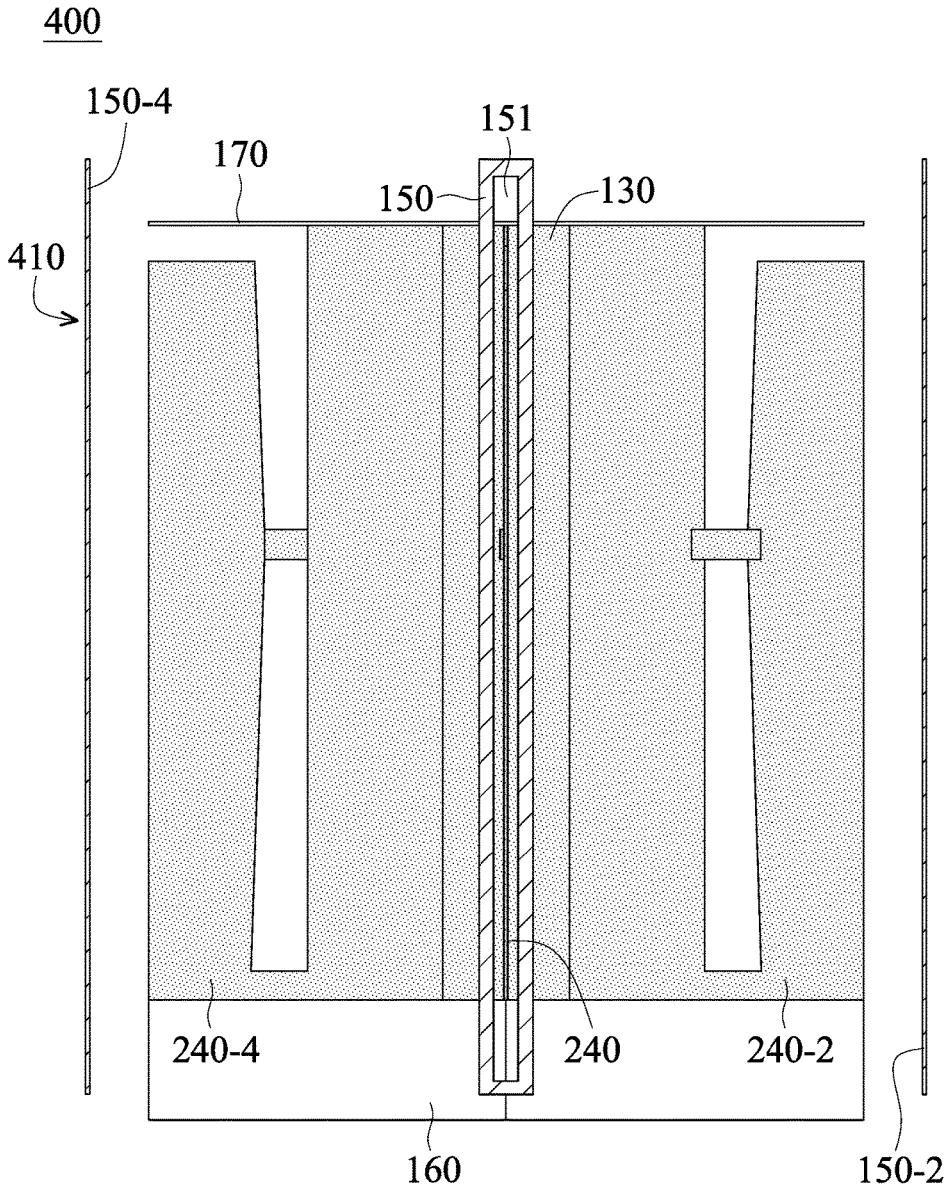
FIG. 4D is a side view of a communication device according to an embodiment of the invention, where all the dipole antennas are removed.

FIG. 4A is a perspective view of a communication device 400 according to an embodiment of the invention. FIG. 4B is a top view of the communication device 400 according to an embodiment of the invention. FIG. 4C is a side view of the communication device 400 according to an embodiment of the invention. FIG. 4D is a side view of the communication device 400 according to an embodiment of the invention, where all dual-polarized antennas are temporarily removed. In the embodiment of FIG. 4A, FIG. 4B, FIG. 4C, and FIG. 4D, an antenna system 410 of the communication device 400 further includes a first metal loop 150 disposed adjacent to the first PIFA 240, and the bending portion 246 of the slot 244 of the first PIFA 240 directly touches the top reflective plate 170. That is, the communication device 400 is considered as a combination of the aforementioned communication devices 200 and 300, which includes the design of both the metal loop and the slot extending to the top, so as to further increase the antenna gain of the first PIFA 240. According to the practical measurement, after the first metal loop 150 is used together with the first PIFA 240, the antenna gain of the first PIFA 240 is significantly increased by about 3.5 dBi to about 4.5 dBi. In other embodiments, the antenna system 410 further includes one or more of a second metal loop 150-2, a third metal loop 150-3, and a fourth metal loop 150-4, which are adjacent to the second PIFA 240-2, the third PIFA 240-3, and the fourth PIFA 240-4, respectively. Other features of the communication device 400 of FIG. 4A, FIG. 4B, FIG. 4C, and FIG. 4D are similar to those of the communication device 200 of FIG. 2A, FIG. 2B, FIG. 2C, and FIG. 2D and those of the communication device 300 of FIG. 3A, FIG. 3B, FIG. 3C, and FIG. 3D. Accordingly, these embodiments can achieve similar levels of performance.

Figure 4E:
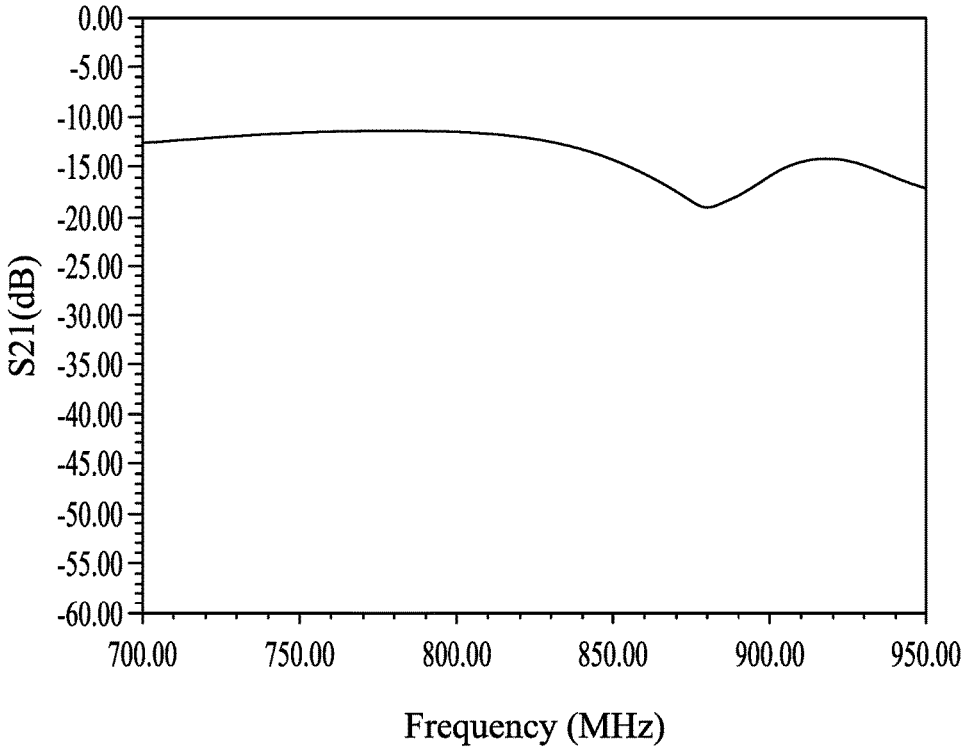
FIG. 4E is a diagram of S parameter of a PIFA (Planar Inverted F Antenna) of an antenna system of a communication device operating in a low-frequency band according to an embodiment of the invention.

FIG. 4E is a diagram of S parameter of the PIFA of the antenna system 410 of the communication device 400 operating in the low-frequency band according to an embodiment of the invention. The horizontal axis represents the operation frequency (MHz), and the vertical axis represents the S21 parameter (dB). In the embodiment of FIG. 4E, the first PIFA 240 is set as a first port (Port 1), and its adjacent second PIFA 240-2 or fourth PIFA 240-4 is set as a second port (Port 2). According to the measurement in FIG. 4E, in the aforementioned low-frequency band, the isolation between two adjacent PIFAs (i.e., the absolute value of the S21 parameter) is at least about 11.4 dB. The antenna gain of each PIFA is increased due to the increase of the isolation, and it can meet the requirements of practical application of general MIMO (Multi-Input and Multi-Output) antenna systems.

Figure 5A:
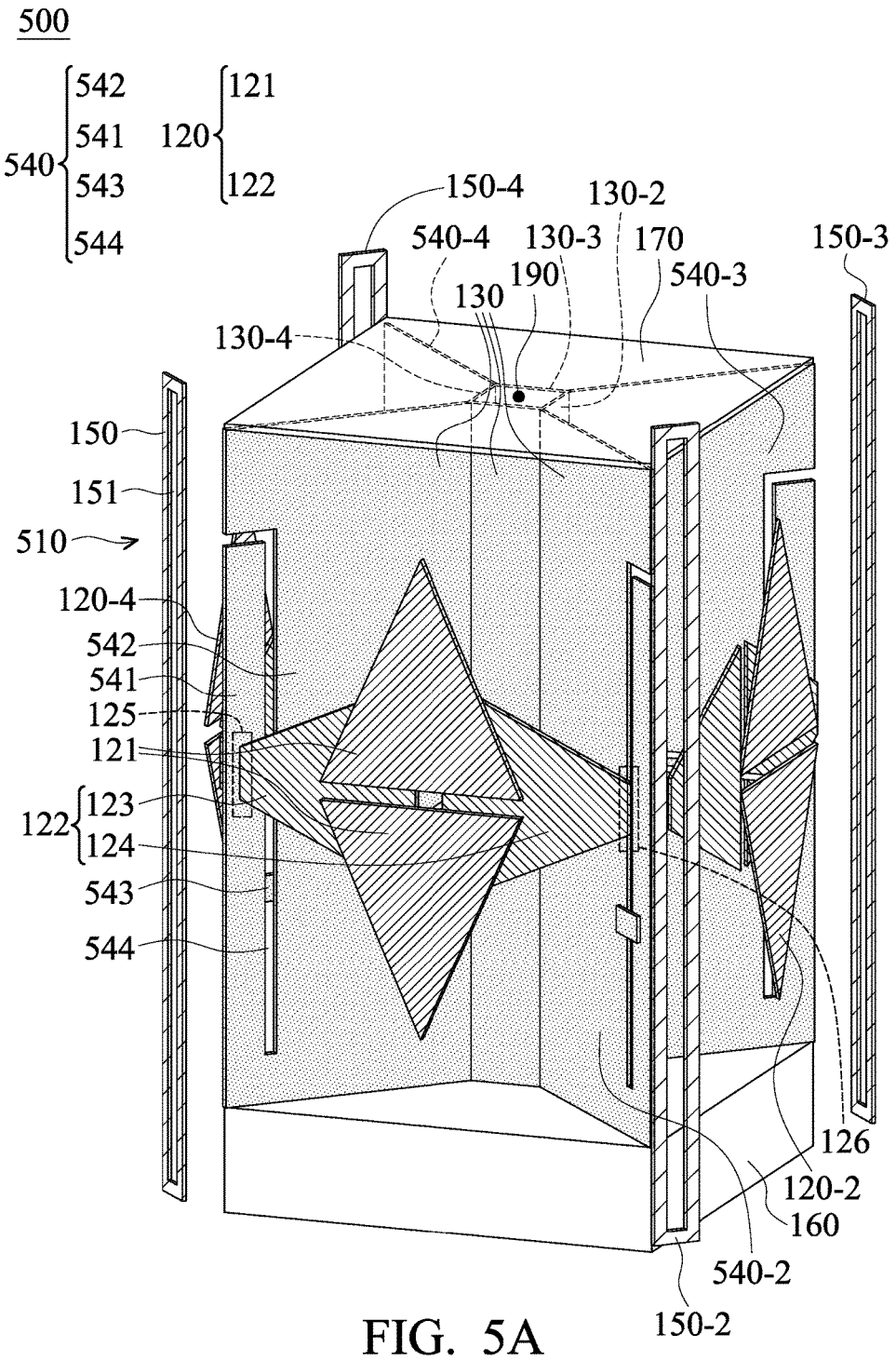
FIG. 5A is a perspective view of a communication device according to an embodiment of the invention.
Figure 5B:
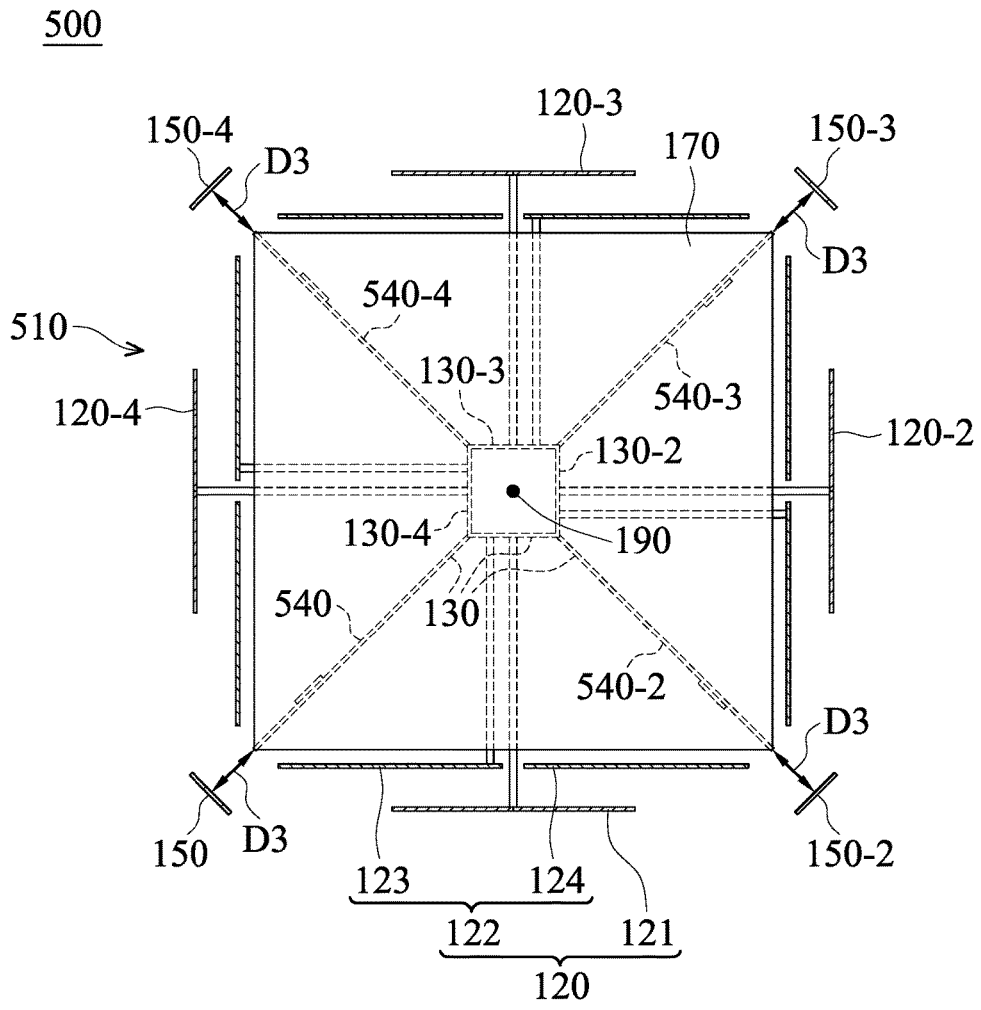
FIG. 5B is a top view of a communication device according to an embodiment of the invention.
Figure 5C:
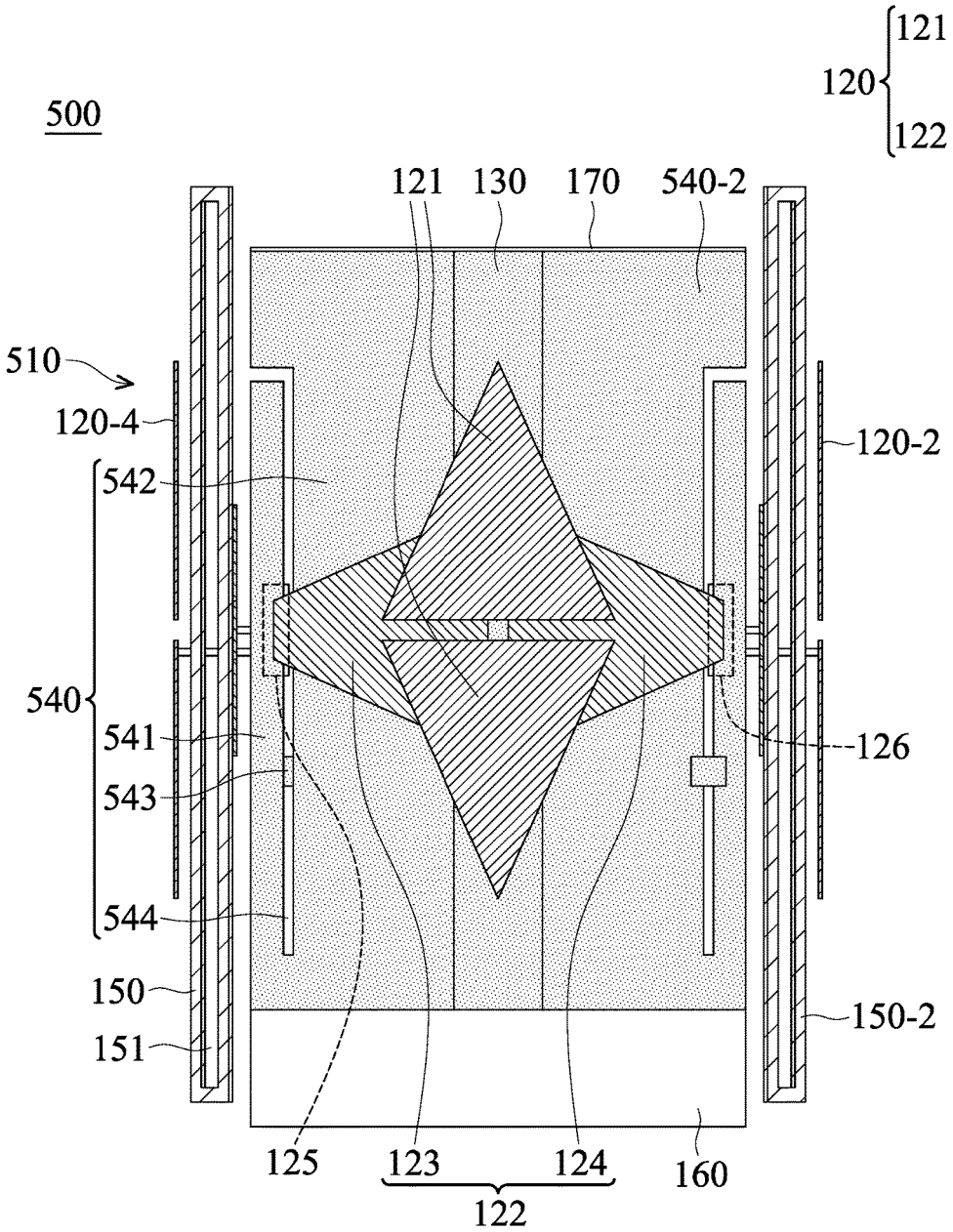
FIG. 5C is a side view of a communication device according to an embodiment of the invention.
Figure 5D:
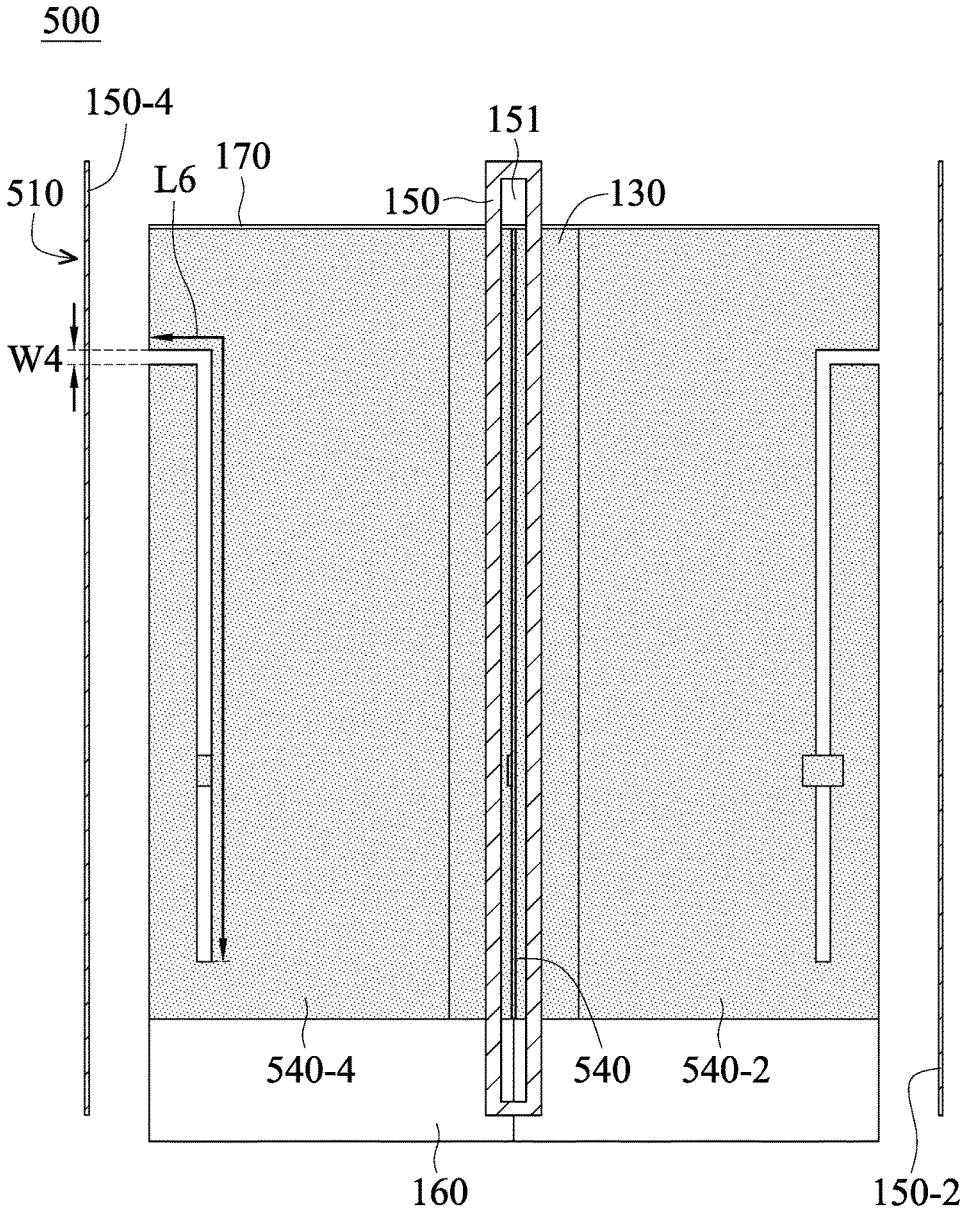
FIG. 5D is a side view of a communication device according to an embodiment of the invention, where all the dipole antennas are removed.

FIG. 5A is a perspective view of a communication device 500 according to an embodiment of the invention. FIG. 5B is a top view of the communication device 500 according to an embodiment of the invention. FIG. 5C is a side view of the communication device 500 according to an embodiment of the invention. FIG. 5D is a side view of the communication device 500 according to an embodiment of the invention, where all dual-polarized antennas are temporarily removed. FIG. 5A, FIG. 5B, FIG. 5C, and FIG. 5D are similar to FIG. 3A, FIG. 3B, FIG. 3C, and FIG. 3D. In the embodiment of FIG. 5A, FIG. 5B, FIG. 5C, and FIG. 5D, an antenna system 510 of the communication device 500 includes a different first PIFA 540. The first PIFA 540 includes a radiation element 541, a grounding element 542, and a feeding element 543. A slot 544 is formed between the radiation element 541 and the grounding element 542. The difference from the embodiment of FIG. 3A, FIG. 3B, FIG. 3C, and FIG. 3D is that the slot 544 has an equal-width L-shape without being widened, and it can at least partially separate the radiation element 541 from the grounding element 542. The feeding element 543 extends across the slot 544, and is further coupled to the radiation element 541, so as to excite the first PIFA 540. The total length L6 of the slot 544 of the first PIFA 540 is substantially equal to 0.25 wavelength ($\lambda/4$) of the central frequency of the low-frequency band of the antenna system 510. The width W4 of the open end of the slot 544 is substantially shorter than 0.3 times the width W1 of the open end of the aforementioned slot 144 being widened. In addition, the antenna system 510 further includes a first metal loop 150 disposed adjacent to the first PIFA 540. The distance D3 between the first metal loop 150 and the first PIFA 540 may be from 5 mm to 15 mm, such as 9.55 mm. The first metal loop 150 is floating, and is completely separated from the first PIFA 540. The first metal loop 150 is configured to partially reflect and partially pass electromagnetic waves of the first PIFA 540, so as to induce the constructive interference thereof. Accordingly, the antenna gain of the first PIFA 540 is increased. According to the practical measurement, after the first metal loop 150 is used together with the first PIFA 540, the antenna gain of the first PIFA 540 is significantly increased by about 3.5 dBi to about 4.5 dBi. In some embodiments, the antenna system 510 further includes one or more of a second PIFA 540-2, a third PIFA 540-3, and a fourth PIFA 540-4. The structures and functions of the second PIFA 540-2, the third PIFA 540-3, and the fourth PIFA 540-4 are the same as those of the first PIFA 540, and the only difference is that they are arranged facing different directions. In other embodiments, the antenna system 510 further includes one or more of a second metal loop 150-2, a third metal loop 150-3, and a fourth metal loop 150-4, which are adjacent to the second PIFA 540-2, the third PIFA 540-3, and the fourth PIFA 540-4, respectively. Other features of the communication device 500 of FIG. 5A, FIG. 5B, FIG. 5C, and FIG. 5D are similar to those of the communication device 300 of FIG. 3A, FIG. 3B, FIG. 3C, and FIG. 3D. Accordingly, the two embodiments can achieve similar levels of performance.

Figure 5E:
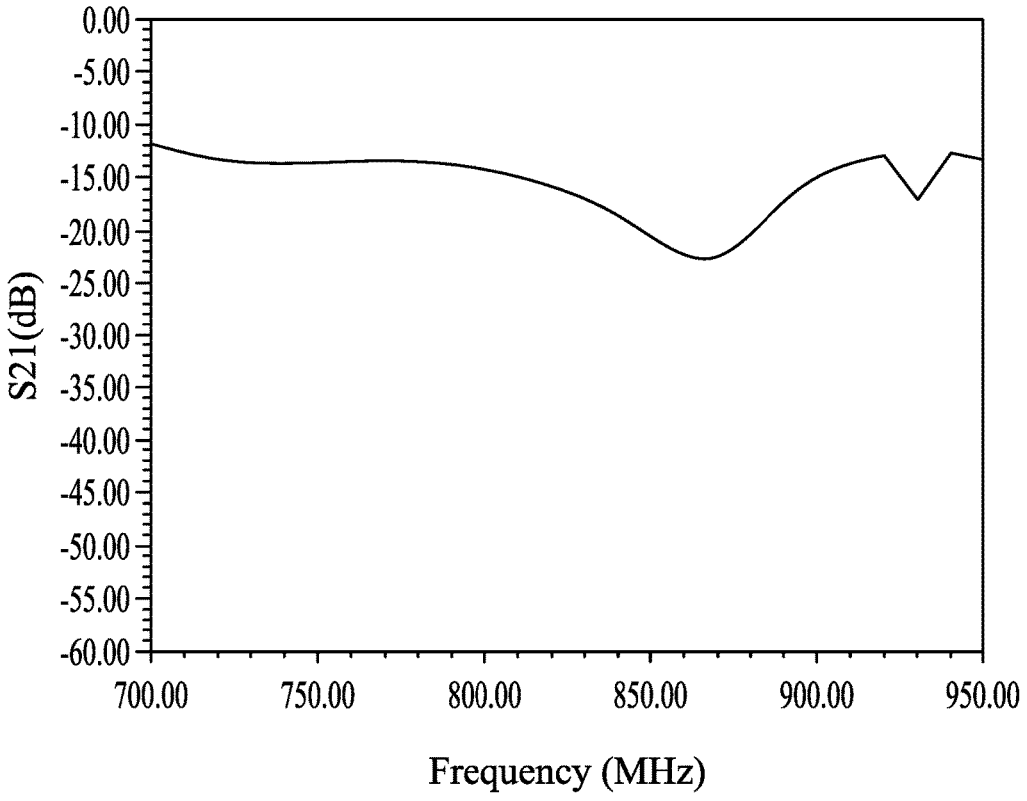
FIG. 5E is a diagram of S parameter of a PIFA of an antenna system of a communication device operating in a low-frequency band according to an embodiment of the invention.

FIG. 5E is a diagram of S parameter of the PIFA of the antenna system 510 of the communication device 500 operating in the low-frequency band according to an embodiment of the invention. The horizontal axis represents the operation frequency (MHz), and the vertical axis represents the S21 parameter (dB). In the embodiment of FIG. 5E, the first PIFA 540 is set as a first port (Port 1), and its adjacent second PIFA 540-2 or fourth PIFA 540-4 is set as a second port (Port 2). According to the measurement in FIG. 5E, in the aforementioned low-frequency band, the isolation between two adjacent PIFAs is at least about 13.4 dB. The antenna gain of each PIFA is increased due to the increase of the isolation, and it can meet the requirements of practical application of general MIMO antenna systems.

Figure 6A:
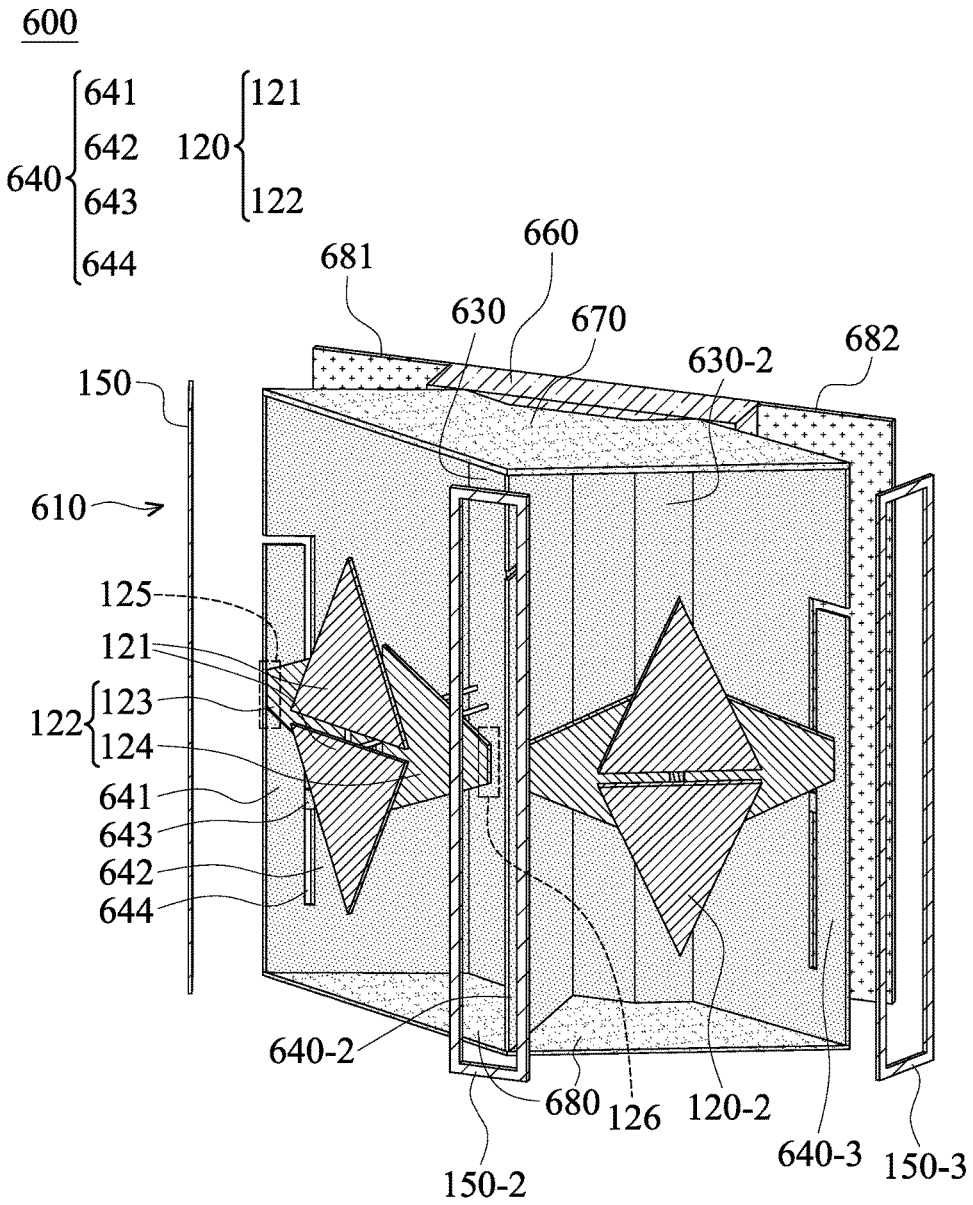
FIG. 6A is a perspective view of a communication device according to another embodiment of the invention.
Figure 6B:
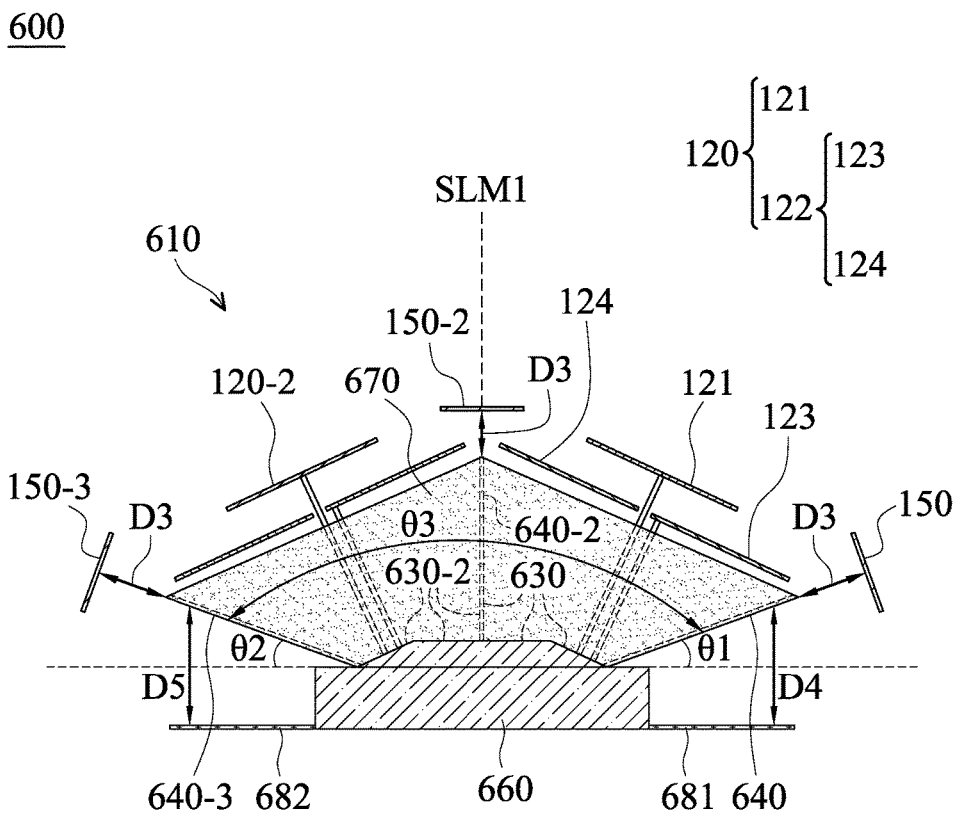
FIG. 6B is a top view of the communication device according to another embodiment of the invention.
Figure 6C:
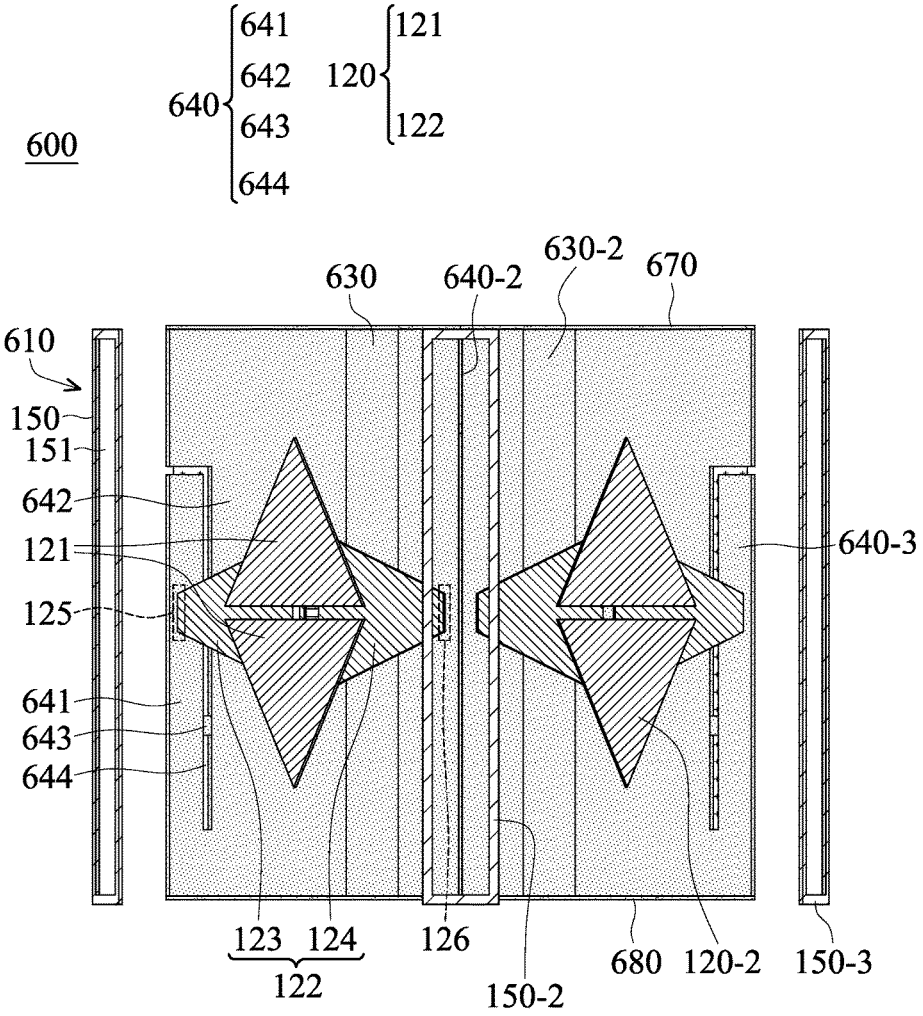
FIG. 6C is a side view of the communication device according to another embodiment of the invention.
Figure 6D:
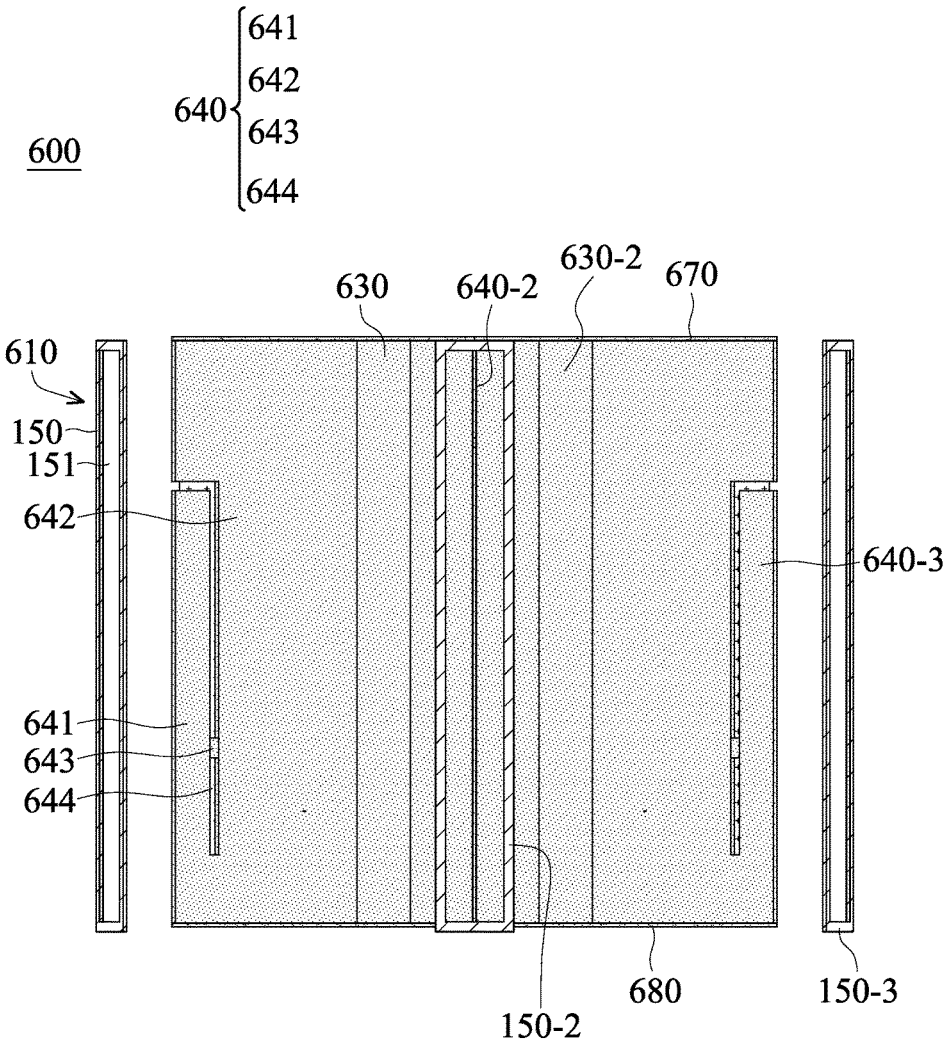
FIG. 6D is a side view of the communication device according to another embodiment of the invention, where all dual-polarized antennas are temporarily removed.

FIG. 6A is a perspective view of a communication device 600 according to another embodiment of the invention. FIG. 6B is a top view of the communication device 600 according to another embodiment of the invention. FIG. 6C is a side view of the communication device 600 according to another embodiment of the invention. FIG. 6D is a side view of the communication device 600 according to another embodiment of the invention, where all dual-polarized antennas are temporarily removed. The communication device 600 can be applied in a wireless access point. As shown in FIG. 6A, FIG. 6B, FIGS. 6C, and 6D, the communication device 600 at least includes an antenna system 610. The antenna system 610 at least includes a first dual-polarized antenna 120, a second dual-polarized antenna 120-2, a first reflector 630, a second reflector 630-2, a first PIFA (Planar Inverted F Antenna) 640, a second PIFA 640-2, a third PIFA 640-3, a first metal loop 150, a second metal loop 150-2, and a third metal loop 150-3. Please refer to FIG. 6A, FIG. 6B, FIG. 6C, and FIG. 6D together to understand the invention.

The first dual-polarized antenna 120 and the second dual-polarized antenna 120-2 each includes a first diamond-shaped dipole antenna element 121 and a second diamond-shaped dipole antenna element 122. It should be understood that the first dual-polarized antenna 120 and the second dual-polarized antenna 120-2 have the same structures but are arranged in different directions, and only the first dual-polarized antenna 120 is introduced herein as an example. The first diamond-shaped dipole antenna element 121 and the second diamond-shaped dipole antenna element 122 may be spaced apart to each other and perpendicular to each other. Two tip sharp corners of the second diamond-shaped dipole antenna element 122 are both cut and removed, so as to form two truncated tips 125 and 126. For example, the second diamond-shaped dipole antenna element 122 may include a positive radiation arm 123 and a negative radiation arm 124, and the positive radiation arm 123 and the negative radiation arm 124 may each have a substantially trapezoidal shape. The positive radiation arm 123 and the negative radiation arm 124 are symmetrical. It should be noted that as shown in FIG. 6B, the antenna system 600 has a central axis SLM1, which is considered as an axis of symmetry relative to the antenna system 600. In some embodiments, the first dual-polarized antenna 120 and the second dual-polarized antenna 120-2 are symmetrical with respect to the central axis SLM1 of the antenna system 600.

The first reflector 630 is disposed adjacent to the first dual-polarized antenna 120, and is configured to reflect the radiation energy from the first dual-polarized antenna 120. The second reflector 630-2 is disposed adjacent to the second dual-polarized antenna 120-2, and is configured to reflect the radiation energy from the second dual-polarized antenna 120-2. It should be noted that the term "adjacent" or "close" over the disclosure means that the distance (spacing) between two corresponding elements is smaller than a predetermined distance (e.g., 10 mm or shorter). The first reflector 630 and the second reflector 630-2 may each have a frustum of a pyramidal shape with a wide top opening and a narrow bottom plate. The wide top opening of the first reflector 630 faces the first dual-polarized antenna 120. For example, the wide top opening of the first reflector 630 may have a relatively large rectangular shape, and the narrow bottom plate of the first reflector 630 may have a relatively small rectangular shape, but it is not limited thereto. The first reflector 630 and the first dual-polarized antenna 120 are electrically isolated from each other. The wide top opening of the second reflector 630-2 faces the second dual-polarized antenna 120-2. For example, the wide top opening of the second reflector 630-2 may have a relatively large rectangular shape, and the narrow bottom plate of the second reflector 630-2 may have a relatively small rectangular shape, but it is not limited thereto. The second reflector 630-2 and the second dual-polarized antenna 120-2 are electrically isolated from each other. In some embodiments, the first reflector 630 and the second reflector 630-2 are symmetrical with respect to the central axis SLM1 of the antenna system 600.

The first PIFA 640 is at least partially formed by the first reflector 630. The second PIFA 640-2 is at least partially formed by a combination of the first reflector 630 and the second reflector 630-2. The third PIFA 640-3 is at least partially formed by the second reflector 630-2. The first PIFA 640 includes a radiation element 641, a grounding element 642, and a feeding element 643, and a slot 644 is formed between the radiation element 641 and the grounding element 642. It should be understood that the first PIFA 640, the second PIFA 640-2, and the third PIFA 640-3 have the same structures but are arranged in different directions, and only the first PIFA 640 is introduced herein as an example. The radiation element 641 and the grounding element 642 of the first PIFA 640 may be a portion of a sidewall of the first reflector 630. The slot 644 may have an equal-width L-shape, and it can at least partially separate the radiation element 641 from the grounding element 642. The feeding element 643 extends across the slot 644, and is further coupled to the radiation element 641. However, the invention is not limited to the above. In alternative embodiments, the slot 644 has a varying-width L-shape, and its details are similar to those described in the embodiments of FIGS. 1A to 1D or FIGS. 2A to 2D. In some embodiments, the first PIFA 640 and the third PIFA 640-3 are symmetrical with respect to the central axis SLM1 of the antenna system 600.

The first metal loop 150 is disposed adjacent to the first PIFA 640. The first metal loop 150 is floating, and is completely separated from the first PIFA 640. The second metal loop 150-2 is disposed adjacent to the second PIFA 640-2. The second metal loop 150-2 is floating, and is completely separated from the second PIFA 640-2. The third metal loop 150-3 is disposed adjacent to the third PIFA 640-3. The third metal loop 150-3 is floating, and is completely separated from the third PIFA 640-3. For example, the first metal loop 150, the second metal loop 150-2, and the third metal loop 150-3 may each have a hollow rectangular shape. It should be understood that the first metal loop 150, the second metal loop 150-2, and the third metal loop 150-3 have the same structures but are arranged in different directions, and only the first metal loop 150 is introduced herein as an example. The first PIFA 640 is positioned between the first metal loop 150 and the narrow bottom plate of the first reflector 630. A rectangular hollow portion 151 may be formed inside the first metal loop 150. In some embodiments, the first metal loop 150 and the third metal loop 150-3 are symmetrical with respect to the central axis SLM1 of the antenna system 600.

In some embodiments, the first PIFA 640, the second PIFA 640-2, and the third PIFA 640-3 can each cover a low-frequency band from 746 MHz to 894 MHz, and the first dual-polarized antenna 120 and the second dual-polarized antenna 120-2 can each cover a high-frequency band from 1710 MHz to 2155 MHz.

In some embodiments, the communication device 600 further includes a top reflective plate 670 and a bottom reflective plate 680. The top reflective plate 670 and the bottom reflective plate 680 are both coupled to the first reflector 630 and the second reflector 630-2. The top reflective plate 670 and the bottom reflective plate 680 are both perpendicular to the first reflector 630 and the second reflector 630-2. The top reflective plate 670 and the bottom reflective plate 680 are configured to enhance the antenna gain of the antenna system 610.

In some embodiments, the communication device 600 further includes an electronic-circuit metal box 660, a first additional reflector 681, and a second additional reflector 682. The electronic-circuit metal box 660 may have a hollow structure for accommodating a variety of electronic circuit elements, such as a processor, an antenna switching module, and a matching circuit. The electronic-circuit metal box 660 is disposed adjacent to the back side of the first reflector 630 and the back side of the second reflector 630-2. Alternatively, the electronic-circuit metal box 660 may be directly touch both the narrow bottom plate of the first reflector 630 and the narrow bottom plate of the second reflector 630-2. Such an arrangement of the electronic-circuit metal box 660 can free-up much of the circuit design area on a main PCB (Printed Circuit Board). The first additional reflector 681 and the second additional reflector 682 may each be implemented with its own respective rectangular metal plane. The first additional reflector 681 is coupled to the electronic-circuit metal box 660, and is disposed adjacent to the first PIFA 640. The first PIFA 640 may have a vertical projection on the first additional reflector 681, and the whole vertical projection of the first PIFA 640 may be inside the first additional reflector 681. The first additional reflector 681 is configured to eliminate the back-side radiation of the first PIFA 640 and to enhance the front-side radiation of the first PIFA 640. The second additional reflector 682 is coupled to the electronic-circuit metal box 660, and is disposed adjacent to the third PIFA 640-3. The third PIFA 640-3 may have a vertical projection on the second additional reflector 682, and the whole vertical projection of the third PIFA 640-3 may be inside the second additional reflector 682. The second additional reflector 682 is configured to eliminate the back-side radiation of the third PIFA 640-3 and to enhance the front-side radiation of the third PIFA 640-3. In some embodiments, the first additional reflector 681 and the second additional reflector 682 are symmetrical with respect to the central axis SLM1 of the antenna system 600.

In some embodiments, the antenna system 610 is a beam switching antenna assembly for selectively using any one of the first dual-polarized antenna 120 and the second dual-polarized antenna 120-2 and selectively using any adjacent two of the first PIFA 640, the second PIFA 640-2, and the third PIFA 640-3, so to perform signal reception and transmission. For example, the second PIFA 640-2 may be always enabled, either the first dual-polarized antenna 120 or the second dual-polarized antenna 120-2 may be enabled (the other one may be disabled), and either the first PIFA 640 or the third PIFA 640-3 may be enabled (the other one may be disabled).

In some embodiments, the element sizes of the antenna system 610 are as follows. The distance D3 between the first metal loop 150 and the first PIFA 640 (or between the second metal loop 150-2 and the second PIFA 640-2, or between the third metal loop 150-3 and the third PIFA 640-3) may be from 5 mm to 15 mm, such as 9.55 mm. The length of each rectangular hollow portion of the first metal loop 150, the second metal loop 150-2, and the third metal loop 150-3 may be from 0.25 to 0.5 wavelength ($\lambda/4$ to $\lambda/2$) of the central frequency of the low-frequency band of the antenna system 610. The angle θ1 between the first PIFA 640 and the electronic-circuit metal box 660 (or between the first PIFA 640 and the first additional reflector 681) may be from 20 to 40 degrees, such as 30 degrees. The angle θ2 between the third PIFA 640-3 and the electronic-circuit metal box 660 (or between the third PIFA 640-3 and the second additional reflector 682) may be from 20 to 40 degrees, such as 30 degrees. The angle θ3 between the first PIFA 640 and the third PIFA 640-3 may be smaller than 180 degrees. For example, the angle θ3 between the first PIFA 640 and the third PIFA 640-3 may be from 100 to 140 degrees. The average distance D4 between the first PIFA 640 and the first additional reflector 681 may be equal to 0.25 wavelength ($\lambda/4$) of the central frequency of the low-frequency band of the antenna system 610. The average distance D5 between the third PIFA 640-3 and the second additional reflector 682 may be equal to 0.25 wavelength ($\lambda/4$) of the central frequency of the low-frequency band of the antenna system 610. The above ranges of element sizes are calculated and obtained according to many experiment results, and they help to optimize the operation bandwidth, the radiation pattern, the antenna gain, and the impedance matching of the antenna system 610 of the communication device 600.

Figure 6E:
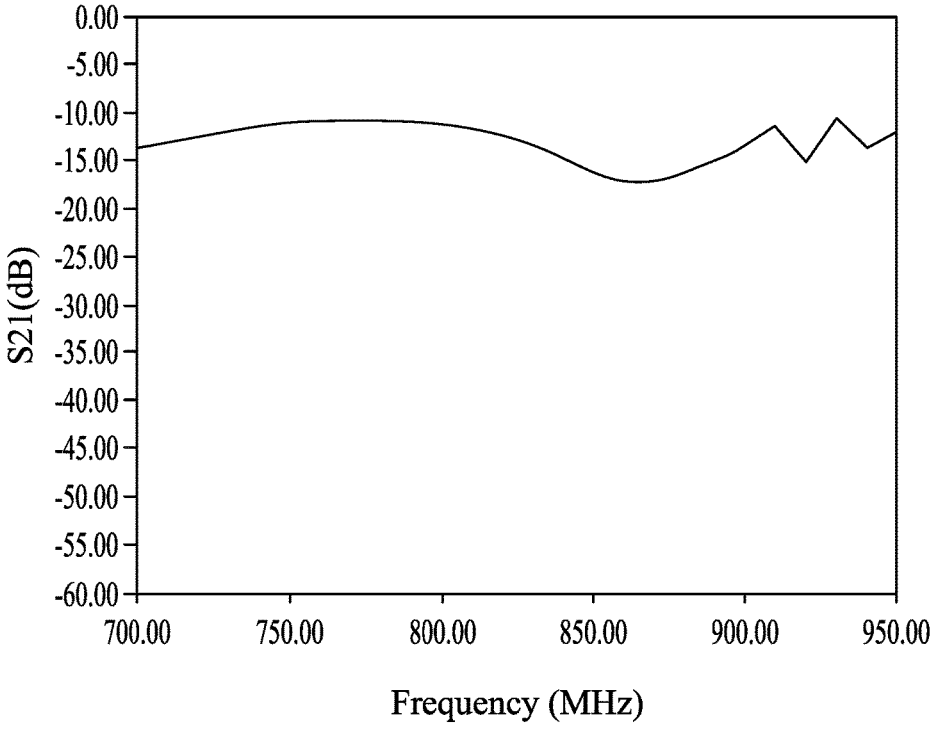
FIG. 6E is a diagram of S parameter of a PIFA of an antenna system of a communication device operating in a low-frequency band according to an embodiment of the invention.

FIG. 6E is a diagram of S parameter of the PIFA of the antenna system 610 of the communication device 600 operating in the low-frequency band according to an embodiment of the invention. The horizontal axis represents the operation frequency (MHz), and the vertical axis represents the S21 parameter (dB). In the embodiment of FIG. 6E, the second PIFA 640-2 is set as a first port (Port 1), and its adjacent first PIFA 640 or third PIFA 640-3 is set as a second port (Port 2). According to the measurement in FIG. 6E, in the aforementioned low-frequency band, the isolation between two adjacent PIFAs is at least about 9.13 dB. The antenna gain of each PIFA is increased due to the increase of the isolation, and it can meet the requirements of practical application of general MIMO antenna systems.

The communication device 600 of FIGS. 6A to 6E is considered as a simplified design of the above embodiments. The communication device 600 substantially includes only half of the components of each of the communication devices 100 to 500. Such a design not only reduces the total manufacturing cost but also minimizes the total device size, and it is more similar to a planar antenna design. According to practical measurement, the antenna system 610 of the communication device 600 covers a 120-degree spatial angle. The first reflector 630 and the second reflector 630-2 may be both slightly rotated toward their central symmetrical axis (respectively by the first angle θ1 and the second angle θ2), so as to enhance the maximum antenna gain. It should be noted any feature of the communication devices 100 to 500 described in the above embodiments may be applied to the communication device 600.

Figure 7:
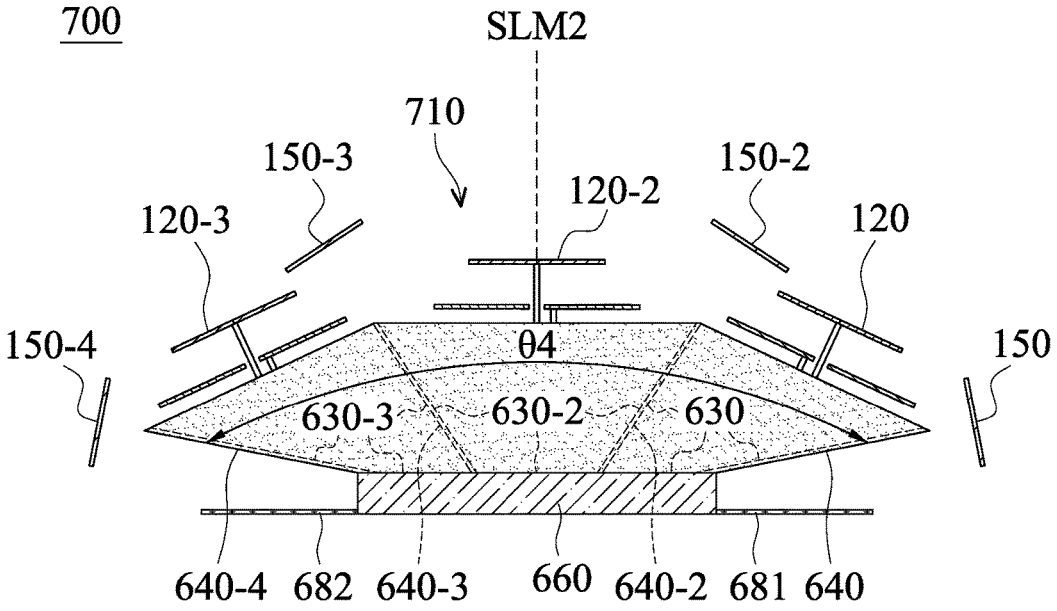
FIG. 7 is a top view of a communication device according to another embodiment of the invention.

FIG. 7 is a top view of a communication device 700 according to another embodiment of the invention. FIG. 7 is similar to FIG. 6B. In the embodiment of FIG. 7, an antenna system 710 of the communication device 700 further includes a third dual-polarized antenna 120-3, a third reflector 630-3, a fourth PIFA 640-4, and a fourth metal loop 150-4. The third reflector 630-3 is disposed adjacent to the third dual-polarized antenna 120-3. The fourth PIFA 640-4 is at least partially formed by the third reflector 630-3. The fourth metal loop 150-4 is disposed adjacent to the fourth PIFA 640-4. The fourth metal loop 150-4 is floating, and is completely separated from the fourth PIFA 640-4. The functions and structure of the third dual-polarized antenna 120-3, the third reflector 630-3, the fourth PIFA 640-4, and the fourth metal loop 150-4 are similar to those described in the above embodiments. The positions of components of the antenna system 710 are slightly adjusted so as to form a symmetrical arrangement. It should be noted that as shown in FIG. 7, the antenna system 700 has a central axis SLM2, which is considered as an axis of symmetry relative to the antenna system 700. In some embodiments, the first dual-polarized antenna 120 and the third dual-polarized antenna 120-3 are symmetrical with respect to the central axis SLM2 of the antenna system 700. In some embodiments, the first PIFA 640 and the fourth PIFA 640-4 are symmetrical with respect to the central axis SLM2 of the antenna system 700, and the second PIFA 640-2 and the third PIFA 640-3 are symmetrical with respect to the central axis SLM2 of the antenna system 700. The angle θ4 between the first PIFA 640 and the fourth PIFA 640-4 may be smaller than 180 degrees. For example, the angle θ4 between the first PIFA 640 and the fourth PIFA 640-4 may be from 140 to 180 degrees. In some embodiments, the antenna system 710 is a beam switching antenna assembly for selectively using any one of the first dual-polarized antenna 120, the second dual-polarized antenna 120-2, and the third dual-polarized antenna 120-3 and selectively using any adjacent two of the first PIFA 640, the second PIFA 640-2, the third PIFA 640-3, and the fourth PIFA 640-4, so to perform signal reception and transmission. It should be understood that although there are exactly three dual-polarized antennas and four PIFAs displayed in FIG. 7, in alternative embodiments, the total number of dual-polarized antennas and the total number of PIFAs are adjustable according to different design requirements. For example, "N" dual-polarized antennas and "N+1" PIFAs may be used together, where "N" may be any positive integer. Other features of the communication device 700 of FIG. 7 are similar to those of the communication device 600 of FIG. 6A, FIG. 6B, FIG. 6C, and FIG. 6D. Accordingly, the two embodiments can achieve similar levels of performance.

The invention proposes a communication device whose antenna system has the advantages of high isolation and high antenna gain. The invention is suitable for application in a variety of indoor environments, so as to solve the problems of poor communication quality due to signal reflection and multipath fading in conventional designs.

Note that the above element sizes, element parameters, element shapes, and frequency ranges are not limitations of the invention. An antenna designer can fine-tune these settings or values according to different requirements. It should be understood that the communication device and antenna system of the invention are not limited to the configurations of FIGS. 1-7. The invention may merely include any one or more features of any one or more embodiments of FIGS. 1-7. In other words, not all of the features displayed in the figures should be implemented in the communication device and antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

an antenna system, comprising:

a first dual-polarized antenna;

a first reflector, disposed adjacent to the first dual-polarized antenna;

a second dual-polarized antenna;

a second reflector, disposed adjacent to the second dual-polarized antenna;

a first PIFA (Planar Inverted F Antenna), at least partially formed by the first reflector; and a second PIFA, at least partially formed by the first reflector and the second reflector;

a third PIFA, at least partially formed by the second reflector;

a first metal loop, disposed adjacent to the first PIFA, wherein the first metal loop is floating and completely separated from the first PIFA;

a second metal loop, disposed adjacent to the second PIFA, wherein the second metal loop is floating and completely separated from the second PIFA; and a third metal loop, disposed adjacent to the third PIFA, wherein the third metal loop is floating and completely separated from the third PIFA.

2. The communication device as claimed in claim 1, wherein each of the first dual-polarized antenna and the second dual-polarized antenna comprises a first diamond-shaped dipole antenna element and a second diamond-shaped dipole antenna element, and wherein the second diamond-shaped dipole antenna element has two truncated tips.

3. The communication device as claimed in claim 2, wherein the first diamond-shaped dipole antenna element and the second diamond-shaped dipole antenna element are spaced apart from each other, and are perpendicular to each other.

4. The communication device as claimed in claim 2, wherein the second diamond-shaped dipole antenna element comprises a positive radiation arm and a negative radiation arm, and wherein each of the positive radiation arm and the negative radiation arm has a trapezoidal shape.

5. The communication device as claimed in claim 1, wherein each of the first PIFA, the second PIFA, and the third PIFA comprises a radiation element, a grounding element, and a feeding element, and wherein a slot is formed between the radiation element and the grounding element.

6. The communication device as claimed in claim 1, wherein the first dual-polarized antenna and the second dual-polarized antenna are symmetrical with respect to a central axis of the antenna system, wherein the first PIFA and the third PIFA are symmetrical with respect to the central axis of the antenna system, and wherein an angle between the first PIFA and the third PIFA is smaller than 180 degrees.

7. The communication device as claimed in claim 6, wherein the angle between the first PIFA and the third PIFA is from 100 to 140 degrees.

8. The communication device as claimed in claim 1, wherein the first reflector is configured to reflect radiation energy from the first dual-polarized antenna, wherein the first reflector has a frustum with a wide top opening and a narrow bottom plate, and wherein the wide top opening of the first reflector faces the first dual-polarized antenna.

9. The communication device as claimed in claim 1, wherein the second reflector is configured to reflect radiation energy from the second dual-polarized antenna, wherein the second reflector has a frustum with a wide top opening and a bottom plate, and wherein the wide top opening of the second reflector faces the second dual-polarized antenna.

10. The communication device as claimed in claim 1, wherein each of the first PIFA, the second PIFA, and the third PIFA covers a low-frequency band from 746 MHz to 894 MHz, and wherein each of the first dual-polarized antenna and the second dual-polarized antenna covers a high-frequency band from 1710 MHz to 2155 MHz.

11. The communication device as claimed in claim 1, further comprising:

a top reflective plate, coupled to the first reflector and the second reflector; and a bottom reflective plate, coupled to the first reflector and the second reflector, wherein the top reflective plate and the bottom reflective plate are perpendicular to the first reflector and the second reflector.

12. The communication device as claimed in claim 1, wherein each of the first metal loop, the second metal loop, and the third metal loop has a hollow rectangular shape.

13. The communication device as claimed in claim 1, further comprising:

an electronic-circuit metal box, disposed adjacent to a back side of the first reflector and a back side of the second reflector;

a first additional reflector, coupled to the electronic-circuit metal box, and disposed adjacent to the first PIFA; and a second additional reflector, coupled to the electronic-circuit metal box, and disposed adjacent to the third PIFA.

14. The communication device as claimed in claim 13, wherein an angle between the first PIFA and the electronic-circuit metal box is from 20 to 40 degrees, and wherein an angle between the third PIFA and the electronic-circuit metal box is from 20 to 40 degrees.

15. The communication device as claimed in claim 13, wherein an average distance between the first PIFA and the first additional reflector is equal to 0.25 wavelength of a central frequency of the low-frequency band.

16. The communication device as claimed in claim 13, wherein an average distance between the third PIFA and the second additional reflector is equal to 0.25 wavelength of a central frequency of the low-frequency band.

17. The communication device as claimed in claim 1, wherein the antenna system is a beam switching antenna assembly for selectively using one of the first dual-polarized antenna and the second dual-polarized antenna and selectively using adjacent two of the first PIFA, the second PIFA, and the third PIFA to perform signal reception and transmission.

18. The communication device as claimed in claim 1, wherein the antenna system further comprises a third dual-polarized antenna, a third reflector disposed adjacent to the third dual-polarized antenna, a fourth PIFA at least partially formed by the third reflector, and a fourth metal loop disposed adjacent to the fourth PIFA, and wherein the fourth metal loop is floating and completely separated from the fourth PIFA.

19. The communication device as claimed in claim 18, wherein the first dual-polarized antenna and the third dual-polarized antenna are symmetrical with respect to a central axis of the antenna system, wherein the first PIFA and the fourth PIFA are symmetrical with respect to the central axis of the antenna system, wherein the second PIFA and the third PIFA are symmetrical with respect to the central axis of the antenna system, and wherein an angle between the first PIFA and the fourth PIFA is smaller than 180 degrees.

20. The communication device as claimed in claim 19, wherein the angle between the first PIFA and the fourth PIFA is from 140 to 180 degrees.

* * * * *